United States Patent [19]

Perr

[11] 3,951,117

[45] Apr. 20, 1976

[54] FUEL SUPPLY SYSTEM FOR AN INTERNAL COMBUSTION ENGINE

[75] Inventor: Julius P. Perr, Columbus, Ind.

[73] Assignee: Cummins Engine Company, Inc., Columbus, Ind.

[22] Filed: May 30, 1974

[21] Appl. No.: 474,528

[52] U.S. Cl. ..... 123/139 AQ; 123/139 R; 123/139 AP

[51] Int. Cl.[2] ..... F02M 39/00; F02D 1/04

[58] Field of Search... 123/139 R, 139 AQ, 139 AP, 123/139 AB

[56] References Cited

UNITED STATES PATENTS

| | | | |
|---|---|---|---|
| 2,313,264 | 3/1943 | Reggio | 123/139 R |
| 2,708,353 | 5/1955 | Brady | 123/139 |
| 2,863,438 | 12/1958 | Challis | 123/139 AQ |
| 2,997,994 | 8/1961 | Falberg | 123/139 AQ |
| 3,035,523 | 5/1962 | Kemp et al. | 123/139 |
| 3,557,765 | 1/1971 | Nystrom | 123/139 AQ |
| 3,859,973 | 1/1975 | Dreisin | 123/139 AP |

*Primary Examiner*—Wendell E. Burns
*Assistant Examiner*—James W. Cranson, Jr.
*Attorney, Agent, or Firm*—Hibben, Noyes & Bicknell

[57] ABSTRACT

This disclosure deals with a fuel supply system for an internal combustion engine, the supply system including injectors for injecting fuel into the combustion chambers of the engine, and hydraulic means for adjusting the timing of injection. In one form of the invention, a pump-distributor assembly supplies fuel sequentially to a plurality of injectors, and the hydraulic timing adjustment forms part of the assembly. In another form of the invention, the hydraulic timing adjustment is included in the injectors. The hydraulic timing adjustment responds to parameters of the engine, such as load and/or speed, for varying or holding constant the time of initiation of injection, and is quickly responsive to changes in the parameters.

31 Claims, 17 Drawing Figures

FUEL SUPPLY SYSTEM FOR AN INTERNAL COMBUSTION ENGINE

Numerous systems have been devised for supplying fuel to the combustion chambers of engines such as compression ignition engines. The Reiners U.S. Pat. No. 3,159,152 and the Julius P. Perr U.S. application Ser. No. 390,605, filed Aug. 22, 1973, for example, disclose fuel supply systems wherein the fuel charge or quantity is controlled by adjusting the pressure of the fuel being supplied to the injectors. The foregoing patent and application do not however disclose means for adjusting the timing of injection. Mechanical adjustments have been provided but such adjustments have been relatively expensive, are subject to wear, and are not readily adjustable during engine operation.

It is desirable to be able to adjust the timing of injection during engine operation, because timing has an effect on engine noise, exhaust emissions and efficiency, and a timing adjustment makes it possible to optimize engine performance. Further, an adjustment is advantageous in a moderately high pressure fuel supply system including a pump-distributor assembly, because a considerable amount of flexing of the supply system occurs due to the relatively large quantity of fuel under pressure during injection. Such flexing could be compensated for by adjusting the timing.

It is therefore a principal object of the present invention to provide an improved fuel supply system including hydraulic means for automatically adjusting the timing of injection. The system comprises an injection pump including a body having a charge chamber and a timing chamber formed therein. The charge chamber is connected to receive fuel from a first variable pressure fuel supply, and the timing chamber is connected to receive fuel from a second variable pressure fuel supply. The body further includes a passage leading from said charge chamber to a combustion chamber of an engine. A timing piston is reciprocably mounted in said body between said charge and timing chambers, and a plunger is reciprocably mounted in said body for exerting pressure on fuel in said timing chamber. The fuel in said timing chamber forms a hydraulic link between said plunger and said timing piston, and the length of said link may be varied by controlling the quantity of fuel metered into said timing chamber. This quantity of fuel is a function of the pressure of the fuel supplied thereto, the pressure in turn being responsive to changes in certain engine operating parameters. Movement of said plunger in an injection stroke results in movement of said hydraulic link and said timing piston, thereby forcing fuel from said charge chamber, through said passage and to said combustion chamber. The fuel in the timing chamber is spilled or vented at the end of each injection stroke and is then replenished in each cycle, thereby making the apparatus quickly responsive to changes in the engine operating parameters.

The timing and charge chambers, the timing piston and the plunger may form part of a pump-distributor assembly or they may form part of an injector. The fuel in the timing chamber forms a hydraulic link and the time of initiation of injection is determined by the length of the hydraulic link.

This invention may be better understood from the following detailed description taken in conjunction with the accompanying figures of the drawings, wherein.

Figure 1:
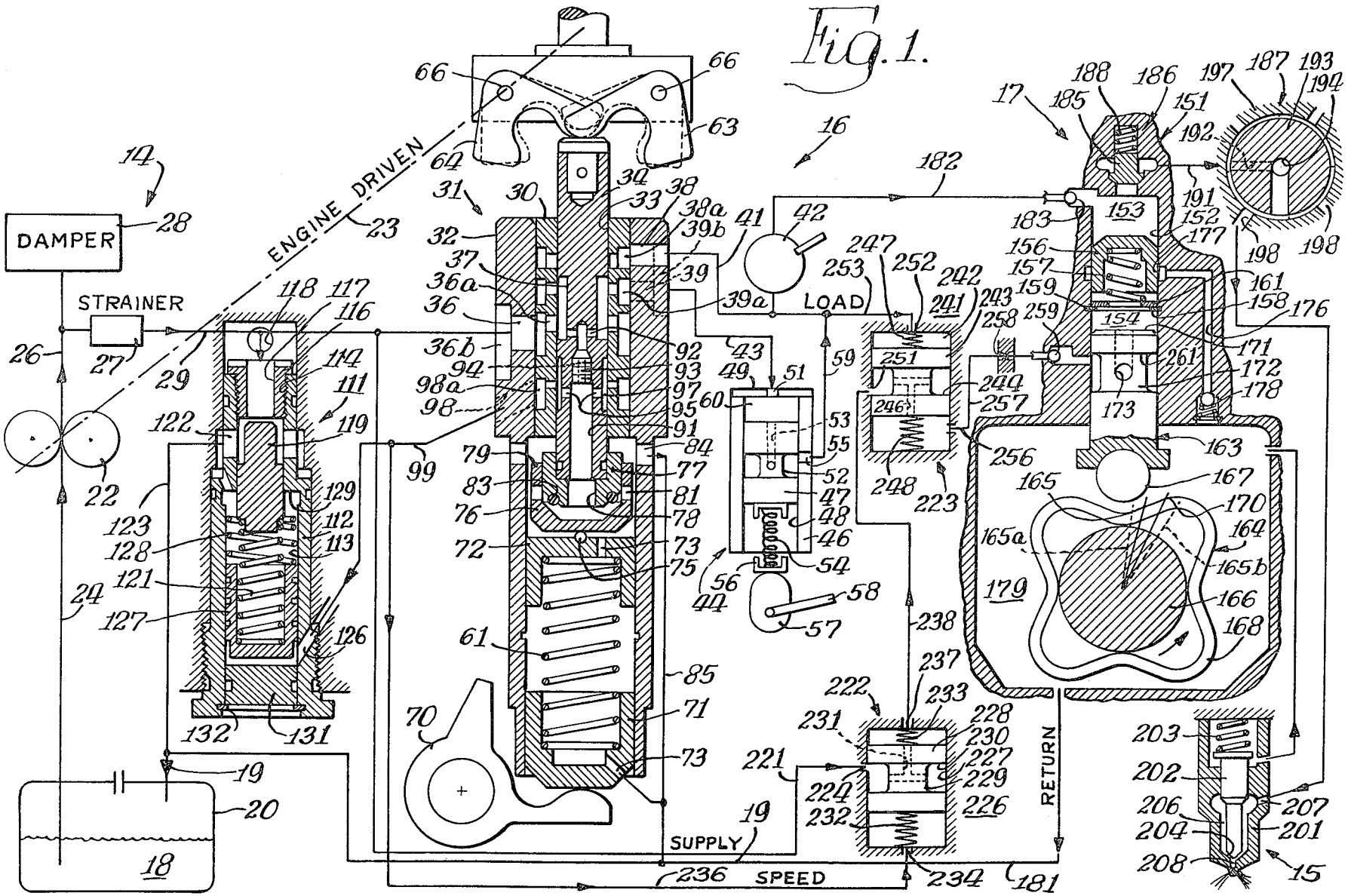
FIG. 1 is a diagram of a fuel supply system including a pump-distributor assembly embodying the invention.

The system illustrated in FIG. 1 includes a plurality of injectors 15 (only one being shown), a pump-distributor assembly 17 for delivering fuel under pressure and sequentially to the injectors 15 in proper order, fuel pressure control apparatus 16 for regulating the pressure of the fuel supplied to the pump-distributor 17 in order to control the charge quantity and the timing, and apparatus 14 for supplying fuel to the pressure control apparatus 16.

The supply apparatus 14 includes a tank 20 containing a quantity of fuel 18. A return rail 19 is connected to the apparatus 16 and 17, the injectors 15 and the tank 20, the line 19 returning excess fuel to the tank 20. The pressure in the tank 20 and in the return line 19 is substantially atmospheric. The fuel supply apparatus 14 further includes a positive displacement pump 22 such as a gear pump which is connected by a drive connection 23 to be driven by the engine. The drive connection 23 drives the pump 22 at a rate which is a function of engine speed, and consequently, the rate at which the fuel 18 is pumped out of the tank 20 is also a function of engine speed. A fuel line 24 connects the intake of the pump 22 with the tank 20, and another fuel line 26 connects the pump output to a fuel strainer 27. A pulsation damper 28 is preferably connected to the fuel line 26 in order to remove any pressure pulses that may be produced by operation of the pump 22.

Fuel from the strainer 27 flows through a fuel line 29 to a centrifugally controlled governing device 31. The device 31 includes a housing 32 which supports a sleeve 30, the sleeve having a plunger bore 33 formed therein, and a reciprocable plunger 34 is movably mounted in the bore 33. A passage or port 36 is formed through the wall of the housing 32 and a plurality of ports **36*a* are formed through the sleeve 30, the ports 36 and 36*a* connecting the fuel line 29 with the plunger bore 33. The plunger 34 may, for example, have an elongated generally cylindrical configuration and include an annular groove 37 which is always in registry with the port 36. The housing 32 and the sleeve 30 also may have idle ports 38 and 38*a*, respectively, for automotive operation, and maximum speed ports 39 and 39*a*, respectively, formed therethrough which are also, at certain times during the operation of the engine, in registry with the groove 37. The ports 36, 38 and 39 are angularly spaced in the body 32, and two ports 39 may be provided. Each of the ports 36***a*, 38*a* and 39*a* may actually consist of a set of angularly spaced ports, each set of ports being connected by an annular groove. Further, the outer periphery of the body 32 at circumferentially spaced points may be machined flat as indicated at 36*b* and 39*b*. The idle port 38 is connected by a fuel line 41 to a shutdown valve 42. As will be described hereinafter, the device 31 serves as a governor at maximum and idle speeds, and also serves as an all-speed governor.

The maximum speed port 39 is connected by another line 43 to a throttle 44 which comprises a housing 46 having a throttle plunger 47 reciprocably mounted in a bore 48 formed in the housing 46. A wall 49 closes one end of the housing 46, and a port 51 in the wall 49 is connected to the line 43. A chamber 60 is formed between the wall 49 and the upper end of the plunger 47. An annular groove 52 is formed in the plunger 47, dividing the plunger 47 into upper and lower portions. A passage 53 is formed in the upper portion of the plunger 47 and extends from the groove 52 to the chamber 60. The other end of the plunger 47 is engaged by a compression spring 54 which is positioned between the plunger 47 and a cam follower 56. A pivotally mounted cam 57 having a manually operated lever 58 attached thereto, engages the follower 56. A port 55 is formed in the wall of the housing 46 adjacent the upper edge of the groove 52, and is connected by a line 59 to the line 41 and to the intake of the valve 42.

In the operation of the throttle 44, fuel flows from the line 43 into the chamber 60, and the fuel pressure pushes the plunger 47 downwardly against the force of the spring 54. The port 55 is located relative to the lower edge of the upper portion of the plunger such that the lower edge increasingly closes off the port 55 as the plunger 47 is forced downwardly by fuel pressure in the chamber 60. The cam 57 and the lever 58 enable an operator to adjust the compression of the spring 54 and, consequently, the amount of force required to move the plunger 47 downwardly. Therefore, at any given setting of the cam 57, the throttle also acts as a pressure regulator because increased pressure in the chamber 60 results in increased closing off of the port 55. As fuel pressure decreases, the port 55 opens. The net result is that the throttle holds the fuel pressure in the rail 18 substantially constant for a given throttle setting. The throttle 44 thereby serves as an automotive governor and provides increased engine stability because it maintains the rail pressure constant at various part throttle settings.

With reference again to the centrifugally controlled device 31, the position of the plunger 34 is controlled by a compression spring 61 and two weights 63 and 64 connected to the drive connection 23 to be rotated at a rate which is a function of engine speed. As the engine speed increases, the two weights 63 and 64 pivot on pins 66 and move the plunger 34 downwardly against the force of the spring 61. Of course, as engine speed decreases, the weights 63 and 64 pivot to permit the spring 61 to return the plunger 34 upwardly.

The spring 61 is positioned between lower and upper cup shaped supports 71 and 72 which are slidably mounted in the housing 32 below the lower end of the plunger 34. The mechanism 31 may be enclosed in a housing filled with fuel at the pressure of the fuel in the return line 19, and holes 73 are preferably formed in the two supports 71 and 72 to permit this low pressure fuel to flow into and out of the space between the supports as the spring 61 expands and contracts. The lower support 71 rests on a manually adjustable, pivotally mounted lever 70. The upper support 72, which is adjacent the plunger, carries a cupped member 76 which fits around the lower end of a circular adaptor 77. A small ball 75 is interposed between the support 72 and the member 76.

The adaptor 77 has a central spill passage 78 formed therethrough, through which fuel flows as will be explained hereinafter. The member 76 includes an outer circular wall portion 79 which fits around the adaptor 77. Spill ports 81 are formed in the wall 79, and an O-ring 83 is mounted in a groove formed in the adaptor 77, between the passage 78 and the ports 81. With little fuel pressure in the passage 78, the inner wall of the member 76 sealingly engages the O-ring 83 and prevents fuel flow out of the passage 78. When sufficient fuel pressure exists in the passage 78, the member 76 is forced downwardly against the force of the spring 61 and separates from the O-ring 83, as shown in FIG. 1, thus spilling fuel from the passage 78 to the ports 81. Any fuel flowing out of the ports 81 flows through ports 84 in the housing 32 and through a line 85 to the return line 19.

Fuel flowing through the passage 78 is derived from an axially extending passage 91 extending from the lower end of the plunger 94 upwardly to approximately its midpoint. The adaptor 77 is sealingly connected to the lower end of the plunger 34, and the passage 78 is aligned with the passage 91. At its upper end, the passage 91 is connected to the groove 37 by a plurality of radial ports 92. An insert 93 having a restricted passage or orifice 94 formed therethrough, is fastened, as by a threaded connection, within the passage 91 below the ports 92. Further, another plurality of radial ports 95 are formed through the plunger 34 from the passage 91 to an annular group 97 formed in the outer surface of the plunger. Ports 98 and 98*a* are formed in the housing 32 and the sleeve 30, respectively, and connect the groove 97 to a line 99.

The mechanism 31 acts as a governor at idling and maximum speeds. At idling speed, the weights 63 and 64 are approximately in the position shown in dashed lines in FIG. 1, and the plunger 34 is upwardly displaced. The idle port 38*a* is located in the sleeve 30 such that it is opened by the upper edge of the groove 37 when the plunger 34 is in its upper position at idling speed. If the engine tends to speed up, the weights 63 and 64 move the plunger 34 downwardly causing the upper edge of the groove 37 to increasingly close the idle port 38*a*. Such closure will decrease the quantity of fuel supplied to the line 41 and the rail 18 and result in a drop in engine speed. The weights 63 and 64 react to the speed drop by permitting the plunger 34 to move upwardly, due to the force of the spring 61, to maintain a sufficient supply of fuel to the injectors to keep the engine running. It will be apparent therefore that the interaction between the upper edge of the groove 37 and the idle port 38*a* provides a governing action at idle speed which maintains the engine idling at the desired speed.

The maximum speed port 39*a* is located in the sleeve 30 such that it will be closed by the upper edge of the groove 37 when the engine speed exceeds the maximum allowable speed of the engine. If the engine speed reaches the maximum allowable speed, the upper edge of the groove 37 starts to close off the port 39*a* and thus reduce the quantity of fuel flowing to the injectors 15. Consequently, the interaction between the upper edge of the groove 37 and the maximum speed port 39*a* serves to control or govern the maximum engine speed and thereby protect the engine.

At intermediate engine speeds between the idle speed and maximum speed, the groove 37 is in the position shown in FIG. 1, wherein the idle port 38*a* is completely closed and the maximum speed port 39*a* is fully open. With the throttle cam 57 moved to the fully open position shown in FIG. 1, pressure regulation at intermediate speeds is provided by a pressure regulator module 111 which is connected to the fuel line 29 and is responsive to engine speed. The module 111 includes a housing 112 having a bore 113 formed therein. One end of the housing 112 is open as at 114 and a fuel control insert 116 is fastened in the opening, an orifice 117 being formed in the fuel control insert 116. The size of the orifice 117 thus may easily be changed by providing a number of inserts such as the insert 116, each having a different size orifice, and installing the insert having the desired orifice size. A line or passage 118 connects the fuel line 29 with the orifice 117. A fuel control plunger 119 within the housing 112 is urged by a compression spring 121 in the direction of the insert 116, and with little or no fuel pressure in the line 29, the plunger 119 closes the orifice 117. The space within the housing 112 around the upper end of the plunger 119 is connected by a port 122 formed in the housing 112 and by a fuel line 123 to the fuel return line 19. Thus, any fuel bypassed from the line 29 through the orifice 117 when the plunger 119 is displaced downwardly flows to the return line 19.

It will be apparent that if the force exerted by the spring 121 on the plunger 119 were not adjustable, the module 111 would operate as a constant pressure regulator and would hold the pressure in the line 29 substantially constant when the pressure in the line 29 exceeds the strength of the spring 121. However, the force exerted by the spring 121 may be varied by a signal that is representative of engine speed, and consequently, the module 111 operates to regulate the pressure in the line 29 in accordance with engine speed to obtain a desirable torque curve.

To this end, another port 126 is formed through the wall of the housing 112 below a cup shaped piston 127 which is movably mounted within the housing 112 below the plunger 119 and the spring 121. A compression spring 128 is positioned between the upper end of the piston 127 and a ledge 129 formed within the housing 112. The upper end of the spring 128 does not engage the ledge 129 until the piston 127 and the spring 128 have moved upward slightly. A closure 131 and a snapping 132 are fastened in the lower end of the bore 113, and form a stop which limits the maximum extent of downward movement of the piston 127. The compression spring 121 is located between the lower end of the plunger 119 and the piston 127, and it will be apparent that if the pressure within the housing 112 between the piston 127 and the closure 131 is sufficient to move the piston 127 upwardly to the position shown in FIG. 1, such upward movement of the piston 127 will increase the force of the spring 121 tending to move the plunger 119 upwardly. This increased force and upward movement of the plunger 119 reduces the effective size of the orifice 117, thereby increasing the pressure in the fuel line 29 because of the decrease in the amount of fuel being bypassed from the line 29 to the return line 19.

As previously mentioned, a speed representative signal appears at the port 126, which may be derived from a separate mechanism but, in the present instance, it is derived from the device 31. The port 126 is connected to the line 99, and the pressure of the fuel in the line 99 constitutes a speed representative signal. When the member 76 engages the seal 83 on the adaptor 77, no fuel flows from the passage 91. However, if the pressure of the fuel in the passage 91 is sufficient, it forces the member 76 downwardly against the force of the spring 61 thereby permitting bypass flow of fuel through the port 92 and the orifice 94, through the passages 91 and 78 and out of the ports 81. This fuel flows out of the housing 32 through the ports 84 which are connected to the return line 19 by the line 85.

The amount of force exerted by the spring 61 to urge the member 76 upwardly may be adjusted by pivoting the lever 70 which has one end engaging the underside of the support 71 at the lower end of the spring 61.

Considering the operation of the portion of the fuel suppply system described thus far, during cranking and starting of the engine, the drive connection 23 turns slowly and the idle port 38 of the centrifugally operated device 31 is open. The pump 22 draws fuel from the tank 20 and delivers it to the fuel line 29. The fuel flows through the ports 36 and 36*a*, the groove 37 and out of the idle ports 38 and 38*a*, through the line 41 and to the pump-distributor 17. The throttle 14 is set, by turning the handle 58 one-quarter turn in the clockwise direction, to close the port 55. The pressure in the line 29 during cranking and starting is normally quite low because of the reduced speed of the engine driven pump 22, and consequently the pressure is not sufficient to force the plunger 119 of the module 111 downwardly against the spring 121 and open the orifice 117, and is not sufficient to force the member 76 downwardly against the force of the spring 61. Therefore, full pressure of the fuel pump 22 is delivered to the pump-distributor 17 during cranking and starting operation.

After the engine starts and the throttle 44 is adjusted to a part throttle position by turning the cam 57, the centrifugal mechanism of the device 31 moves the plunger 34 downwardly and the plunger closes the idle ports 38 and 38*a*, as shown in FIG. 1. The maximum speed ports 39 and 39*a* are however open, and consequently, fuel flows through the ports 39 and 39*a* to the throttle 44, and in normal engine operation at the intermediate speeds, the fuel pressure in the supply rail 18 is regulated by the operator who adjusts the throttle 44. If the throttle 44 is placed in the fully open position shown in FIG. 1, the engine speed will vary with load on the engine. The pressure in the fuel line 29 increases as the drive connection 23 turns faster, because of the increased rate of operation of the pump 22. It should be understood that the pump 22 always delivers more fuel than is required for engine operation. When the pressure in the fuel line 29 reaches a predetermined value, this value being determined by the strength of the compression spring 121, the plunger 119 is moved downwardly by the fuel pressure in the line 29 to partially open the orifice 117. A portion of the fuel flowing from the pump 22 is then bypassed, through the line 118 and the orifice 117 and the bypass port 122 and to the return line 19. In addition, fuel from the line 29 also flows to the port 36 formed in the housing 32 of the device 31. The fuel flowing to the port 36 flows through the groove 37, the ports 92, the orifice 94 and the passage 91, and this fuel pressure is sufficient to force the member 76 downwardly against the force of the spring 61. The effective size of the opening between the lower end of the adaptor 77 and the member 76 will determine the amount of fuel bypassed through the ports 81 and 84 and the line 85 to the return line 19, and this effective size of the opening is determined by the speed of the engine turning the weights 63 and 64, by the fuel pressure in the passage 91, and by the strength of the spring 61. The amount of fuel bypassed through the passage 91 determines the pressure in the line 99 and in the port 126, and since this pressure varies as a function of the speed of the engine, the pressure at the port 126 constitutes a speed representative pressure signal. The orifice 94 maintains pressure in the line 43 even though fuel is bypassed through passage 91.

The pressure of the fuel in the part 126 is applied to the underside of the piston 119 and tends to move the spring 121 and the piston 119 upwardly, increasing the force of the spring 91 on the piston 119. This increased force tends to reduce the size of the orifice 117 and decrease the amount of bypassed fuel flowing to the line 123, which results in an increase in the pressure in the fuel line 29. At high engine speeds, the piston 127 is moved upwardly sufficiently by the speed representative signal to move the outer spring 128 against the ledge 129 formed within the housing 112. Consequently, the spring 128, in addition to the spring 121, resists continued upward movement of the piston 127.

If the engine reaches maximum speed, the plunger 34 is moved downwardly by the weights 63 and 64 to the point where the plunger at the upper edge of the groove 37 starts to close the maximum speed ports 39 and 39*a*, thereby reducing the pressure in the line 43 and reducing engine speed. When the engine speed reduces, the plunger 34 moves upwardly and the ports 39 and 39*a* are again opened. Thus, the mechanism 31 operates as a governor at maximum speed as well as a governor at idling speed.

The pump-distributor assembly 17 receives the fuel from the apparatus 16 and delivers it under pressure, sequentially, to the respective injectors 15. The pump-distributor 17 includes a pump housing 151 having a cylindrical opening or bore 152 formed therein, the bore 152 including a charge chamber 153 and a timing chamber 154. A timing piston 156 is reciprocably mounted in the bore 152 and separates the chambers 153 and 154, the piston 156 being urged in the direction of the charge chamber 153 by a metering spring 157. The spring 157 is supported in the housing 151 by, in the present instance, a snap ring 158 which is mounted in an annular groove 159 formed in the wall of the bore 152. A washer 161 is supported on top of the snap ring 158 and the metering spring 157 is positioned between the timing piston 156 and the washer 161. The piston 156 is in the shape of an inverted cup, and the spring 157 extends into the interior of the cup.

A plunger 163 is also mounted in the housing 151 and reciprocates in the timing chamber 154 below the snap ring 158. The plunger 163 is moved in its reciprocating motion by a cam 164 which is driven by a cam shaft 166 of the engine. A cam follower 167 is fastened to the lower end of the plunger 163 and engages the cam 164. In the present instance, the cam 164 has four lobes 168 resulting in four injection cycles of the plunger 163 in each revolution of the shaft 166.

An annular groove or reduced diameter portion 172 is formed in the outer surface of the plunger 163 intermediate its ends, and the groove 172 is connected to the space above the plunger by a passage 173 which extends radially of the plunger at the groove 172 and then axially to the upper surface 171 of the plunger.

The housing 151 further has formed therein a spill passage 176 including a spill port 177 formed in the wall of the bore 152. The passage 176 extends from the port 177 through a spring loaded check valve 178 and to the interior 179 of a housing for the cam 164. The interior 179 of the housing 151 is connected by a line 181 to the return line 19. The check valve 178 permits flow from the port 177 to the interior 179 but not in the reverse direction.

Another passage 182 connects the outlet of the shutdown valve 42 with the charge chamber 153 above the timing piston 156. A check valve 183 is connected in the passage 182 and permits flow only in the direction of the charge chamber 153.

The charge chamber 153 is further connected through a delivery valve 186 to a distributor 187 which delivers the pump fuel sequentially to the injectors 15. The delivery valve 186 includes a valve member 185 which is loaded by a spring 188 to a normally closed position, and the valve 186 opens only when the pressure on the fuel within the chamber 153 is above a certain value. The outlet of the valve 186 is connected by a line 191 to an inlet passage 192 formed in a housing 197 of the distributor 187. The passage 192 connects with a centrally located passage 194 formed in a rotor 193 of the distributor. The rotor 193 further includes a radially extending passage 196 which leads from the central passage 194 to the exterior surface of the rotor 193, and the housing 197 of the distributor 187 includes, in the present instance, four passages 198 (for a four cylinder engine), each of which leads to an injector 15. As will be described hereinafter, the rotor 193 is driven by the engine in synchronism with the rotation of the cam shaft 166 and the cam 164, so that the passage 196 will be in flow communication with one of the housing passages 198 during each injection stroke of the plunger 163.

Each injector 15, in the present instance, is a closed nozzle type of injector and includes a housing 201 which has a plunger 202 reciprocably mounted therein. A compression spring 203 urges the plunger 202 downwardly into sealing engagement with a valve seat 204. A fuel flow passage 206 is formed in the housing 201 and extends between a fuel inlet 207 and a chamber 208 at the bottom end 209 of the plunger 202. The chamber 208 is connected by spray holes to a combustion chamber of an engine. When the pressure in the chamber 206 increases, due to the pumping action of the plunger 163 as will be explained hereinafter, the plunger 202 is forced upwardly against the force of the spring 203, thus opening the injector for the flow of fuel from the distributor 187 and into the engine combustion chamber.

As will be discussed in greater detail hereinafter, the quantity of fuel contained in the timing chamber 154 at the beginning of an injection stroke determines the time of initiation of injection. The fuel metered into the timing chamber 154 flows through a supply line 221, and the pressure of the fuel is controlled by two pressure modifying or adjusting devices 222 and 223. The device 222 modifies the pressure as a function of engine speed and the device 223 further modifies the pressure as a function of the load on the engine. The supply line 221 is supplied with fuel from the line 29 which leads from the output of the strainer 27 and the device 111, and it is connected to a fuel intake port 224 formed in a housing 226 of the device 222, the port 224 leading to a fuel receiving chamber 227 formed within the housing 226. A plunger or piston 228 is movably mounted in the chamber 227, the piston 228 having an annular groove or reduced diameter portion 229 formed in its outer surface intermediate its ends. A fluid passage 231 extends from the groove 229 to the upper end of the piston 228, the passageway 231 extending radially through the piston 228 at the groove 229 and also extending axially upwardly to the upper end surface of the piston 228. A bottom spring 232 urges the piston 228 upwardly, and an upper spring 233 urges the piston 228 in the downward direction. Another port 234 is formed in the housing 226 and opens into the portion of chamber 227, which is below the piston 228, the port 234 being connected by a line 236 to receive the speed representative signal in the line 99. Still another port 237 is formed in the housing 226, the port 237 opening into the portion of the chamber 227, which is above the piston 228 and the port 237 being connected to the device 223 by a line 238.

The location of the intake port 224 is such that it is adjacent the edge 230 of the piston 228 which forms the upper side of the groove 229. Thus, fuel flows from the line 221, through the intake port 224, to the groove 229, through the passage 231 and through the port 237. The edge 230 normally partially covers the intake port 224. The piston 228 is urged in the upward direction, as viewed in FIG. 1, by the force of the lower spring 232 and also by the pressure of the speed representative signal present in the line 236 and in the lower chamber below the piston 228. The piston 228 is urged in the downward direction by the strength of the spring 233 and by the pressure of the fuel present in the portion of the chamber 227 which is above the piston 228. Thus, in the present example, if the fluid pressure of the speed representative signal in the line 236 increases because of an increase in engine speed, the piston 228 will be pushed in the upward direction and will increase the size of the opening of the inlet port 224, resulting in an increase in the presence of the fuel leaving the port 237 and in the line 238. Of course, if the speed representative signal in the line 236 drops in pressure, the piston 228 will move downwardly and decrease the effective size of the port 224, resulting in a drop in pressure in the line 238. Consequently, the pressure of the fuel in the line 238 will be a function of the pressure of the speed representative signal appearing in the line 236.

With regard to the second pressure modifying device 223, its construction and operation are generally similar to that of the device 222 but it responds to changes in the engine load rather than engine speed. The device 223 includes a housing 241 having a fuel receiving chamber 242 formed therein, and a piston 243 is movably mounted in the chamber 242. The piston 243 also has an annular groove or reduced diameter portion 244 formed therein intermediate its ends, and passage 246 is formed in the piston 243 and connects the groove 244 with the portion of the chamber 242 which is below the piston 243. An upper spring 247 urges the piston 243 downwardly and a lower spring 248 urges the piston 243 upwardly. The fuel line 238 is connected to a fuel intake port 251 formed in the housing 241 which opens into the groove 244. The edge of the piston 243 which forms the lower side of the groove 244 is in a position to partially cover the inlet port 251. Another inlet port 252 is formed in the housing 241 and opens into the upper portion of the chamber 242, which is above the piston 243. The port 252 is connected by a line 253 to the fuel outlet conduit 59 of throttle 44. Since the pressure of the fuel at the outlet of the throttle 44 is a function of the load on the engine, as previously explained, the fuel pressure in the portion of the chamber 242, which is above the piston 243, will also be a function of the load on the engine. A fuel outlet port 256 is formed in the housing 241 and opens into the portion of the chamber 242, which is below the piston 243, the outlet port 256 being connected by a line 257 to the timing chamber 154.

As the load on the engine increases, the fuel pressure in the line 253 and in the upper portion of the chamber 242 increases. This increased fuel pressure and the spring 247 move the piston 243 downwardly against the action of the spring 248 and the fuel pressure at the bottom end of the piston 243, and therefore increasingly opens the port 251. Consequently, in the example illustrated in FIG. 1, the fuel pressure in the line 257 will increase as the load increases and it will decrease as the load decreases.

A flow restricting orifice 258 and a check valve 259 are connected in the line 257 between the outlet port 256 and the timing chamber 154. As shown in FIG. 1, the line 257 opens into the timing chamber 154 at a point which is closely adjacent the edge 261 of the plunger 163, which forms the upper side of the groove 172. When the plunger 163 is in its lower most position, the edge 261 closes the opening of the line 257, but when the plunger 163 is displaced upwardly slightly as shown in FIG. 1 by the cam 164, the line 257 is opened. The check valve 259 is arranged to permit the flow of fuel through the line 257 into the timing chamber 154 but not in the reverse direction.

Considering the operation of the system as a whole with reference to FIGS. 1 through 4, when the engine is running, the fuel supply pump 22 pumps fuel from the tank 13 through the governing device 31 and the throttle 44, and delivers it to the line 182 which leads to the charge chamber 153. The centrifugal mechanism of the device 31 is also driven by the engine as previously explained, and controls the pressure during startup and at high speed operation of the engine. The pressure regulating device 111 and the throttle 44 regulate the fuel pressure in the line 182 during normal operating conditions of the engine.

Figure 4:
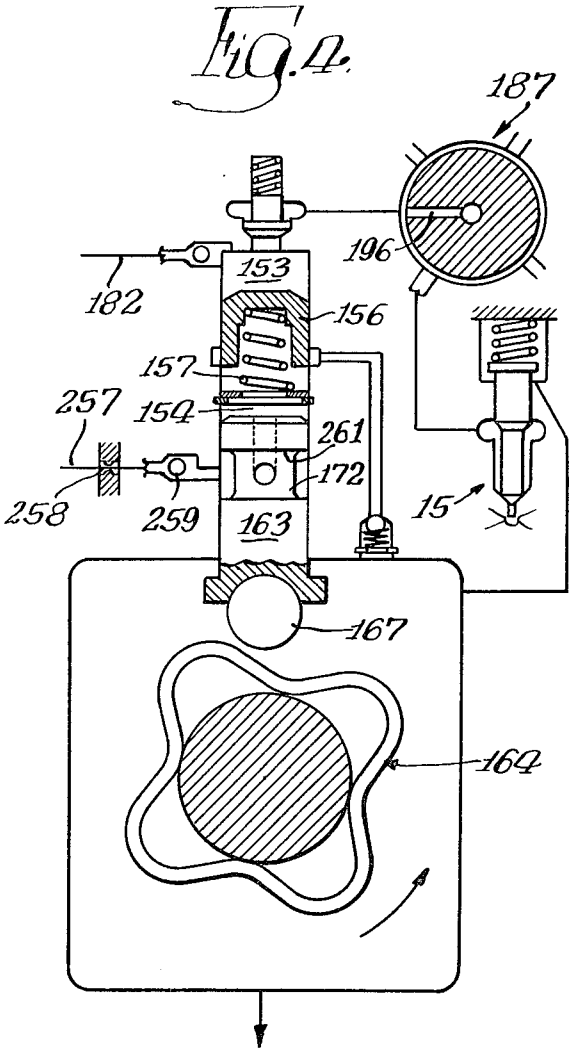
FIGS. 2 to 4 are diagrams of a portion of the system shown in FIG. 1 but illustrating different positions of some of the parts.
Figure 3:
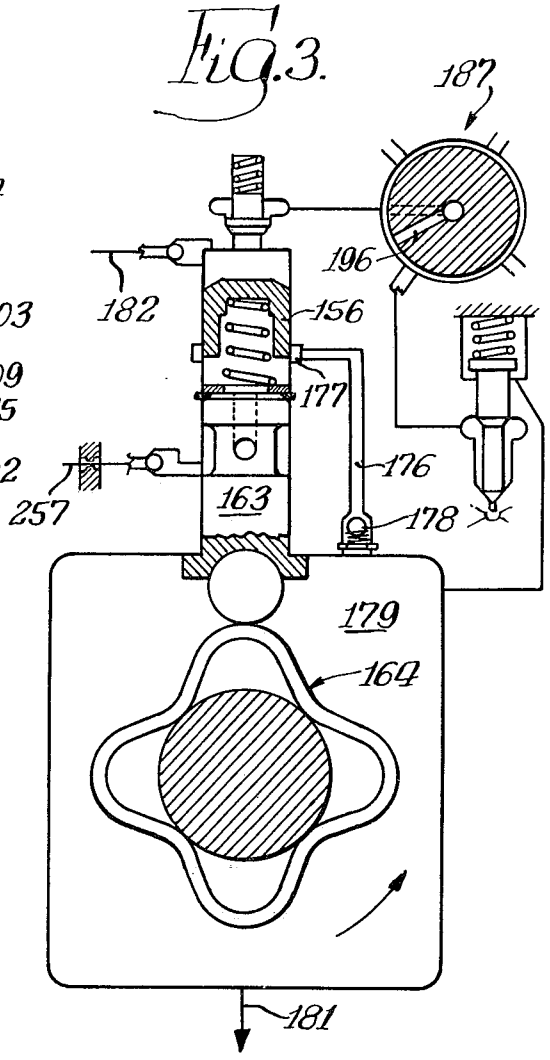
Figure 2:
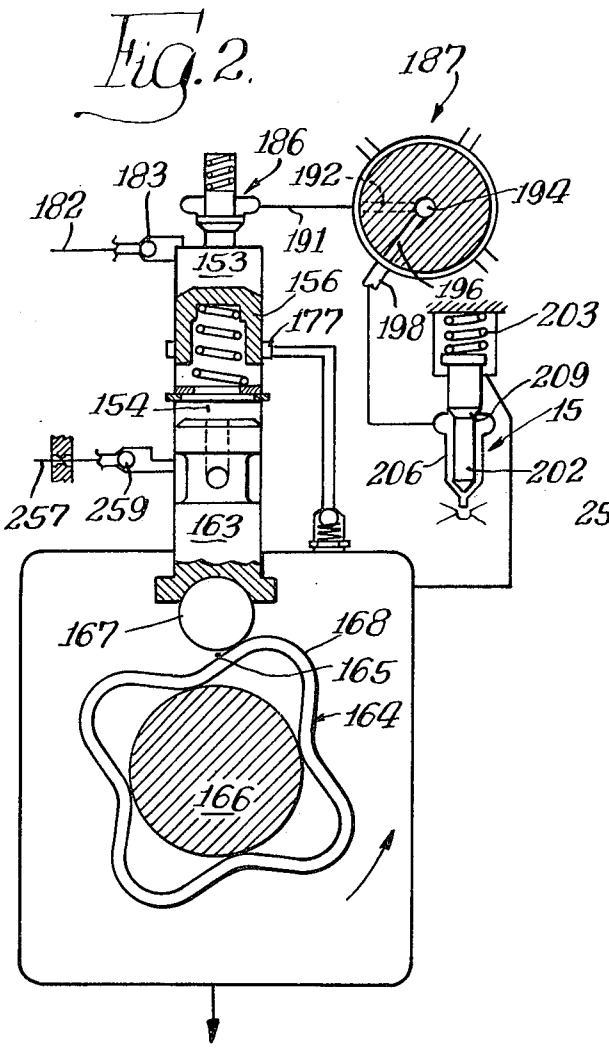

FIG. 1 illustrates the positions of the parts of the fuel distributing apparatus at the beginning of an injection stroke, FIG. 2 illustrates the positions of the parts during the injection stroke, FIG. 3 illustrates the positions of the parts at the end of the injection stroke, and FIG. 4 illustrates the positions of the parts between successive injection strokes and while fuel is being metered into pump-distributor 17 during the fuel metering portion of the cycle. The positions of the timing piston 156 and the plunger 163 are appropriate for an intermediate engine load and for an average timing setting. Starting with the position of the parts shown in FIG. 1, as the cam shaft 166 and the cam 164 are rotated in the counterclockwise direction, the rising side, at approximately the point 165, of the next adjacent cam lobe 168 engages the cam follower 167 and drives it upwardly. Such upward movement increases the pressure on the fuel in the timing chamber 154 and in the charge chamber 153, causing the two check valves 183 and 259 to close. These two check valves close (FIG. 2) because the pressures in the lines 257 and 182 are relatively low as compared with the injection pressures encountered within the chambers 153 and 154. The timing piston 156 covers the spill port 177, and consequently, as soon as the two check valves 183 and 259 close, fuel is trapped in the timing chamber 154 and in the charge chamber 153. Continued upward movement of the plunger 163 due to turning of the cam 164 results in corresponding upwardly movement of the timing piston 156, the quantity of fuel in the timing chamber 154 between the plunger 163 and the piston 156 forming a relatively solid hydraulic link. As will be explained hereinafter, the length of this hydraulic link may be varied by changing the quantity of fuel in the timing chamber 154, such a change resulting in a change in the time of initiation of injection. The plunger 163, the hydraulic link and the fuel charge above the timing piston 156 thus move upwardly as a unit, and the high pressure of the fuel in the charge chamber 153 opens the delivery valve 186. Fuel then flows from the chamber 153, through the line 191, the passages 192, 194 and 196, and out of the distributor 187 through one of the ports 198. This fuel under relatively high pressure enters the fuel passage 206 of the injector 15 and this pressure is exerted on the lower end 209 of the plunger 202, resulting in the plunger 202 being moved upwardly against the force of the spring 203 (FIG. 2). The fuel under the relatively high pressure then flows out of the line 206 through the spray holes of the injector and into the combustion chamber of the engine.

Injection continues until the lower edge of the timing piston 156 moves upwardly far enough to open the spill port 177 (FIG. 3). At this point, fuel from the timing chamber 154 is spilled or discharged through the spill port 177 and the passage 176, causing the check valve 178 to open and the fuel to be discharged into the interior 179 of the housing and through the return line 181 to the supply 13. As soon as the spill port 177 opens, fuel is squeezed out of the timing chamber 154 through the line 176 and the timing piston 156 stops its upward movement. The pressure in the charge chamber 153 therefore drops resulting in a drop in pressure in the passage 206 of the injector 15, this pressure in the injector falling to the point where the compression spring 203 moves the plunger 202 downwardly to its seated position to terminate injection.

It should be noted that the distributor rotor 193 moves in timed relation with the cam 164, both being driven by the engine in timed relation with the piston (or rotor) of an engine. The injection is timed to occur toward the end of the compression stroke of the piston (or rotor). At the time the plunger 163 is driven upwardly, the passage 196 is at a position where it is in flow communication with the line 198 leading to the injector 15 as shown in FIG. 2. As previously mentioned, the cam 164 has four lobes 168 resulting in four injection strokes for each revolution of the shaft 166, and four passages 198 leading to four injectors 15 are provided. To simplify the drawings, only one passage 198 and one injector 15 are shown. The outlet passages 198 are located relative to the passage 196 in the rotor 193, such that the fuel forced out of the charge chamber 153 during each injection stroke of the plunger 163 is delivered sequentially to the four passages 198 and the four injectors in timed relation with the movements of the pistons (or rotors) of the engine.

At the completion of the injection stroke (FIG. 3), the cam shaft 166 continues to turn and the lobe 168 moves away from the follower 167 (FIG. 4). As soon as this occurs, the pressure in the chambers 153 and 154 drops below the fuel pressures in the lines 182 and 257. Fuel then flows through the check valves 183 and 259 into the chambers 153 and 154, moving the timing piston 156 and the plunger 163 downwardly, and the amounts of fuel entering the chambers 153 and 154 depend upon the pressures in the lines 182 and 257.

Regarding the charge chamber 153, fuel from the line 182 fills this chamber and forces the piston 156 downwardly against the force of the metering spring 157. The piston 156 moves downwardly until the force of the spring 157 counterbalances the force exerted by the fuel in the chamber 153, and this force is of course a function of the fuel pressure. Consequently, the quantity of fuel in the charge chamber 153 at the beginning of the next injection stroke is a function of the fuel pressure.

Regarding the timing chamber 154, the amount of fuel flowing into it is a function of the fuel pressure in the line 257. Fuel in the line 257 flows through the orifice 258 and the check valve 259, into the groove 172, through the passage 173, and into the timing chamber 154 between the piston 156 and the plunger 163. Since the cam 164 has moved out of engagement with the follower 167, the plunger 163 is free to move downwardly and therefore the plunger 163 offers little resistance to the entry of fuel into the chamber 154. However, the orifice 258 is a flow restriction in the line 257, and therefore the amount of fuel flowing into the timing chamber 154 in each cycle of movement of the plunger 163 is a function of the pressure of the fuel in the line 257, the size of the orifice 258 and the length of time fuel flows through the orifice into the chamber 154. As the fuel flows into the chamber 154 it moves the plunger 163 downwardly, and normally fuel flows into the chamber 154 until the time that the plunger 163 starts to move upwardly again in the next injection stroke. However, if the pressure is sufficiently high and if the time between adjacent injection strokes is sufficiently long, the chamber 154 will be filled to capacity and the plunger 163 will be moved downwardly sufficiently far for the edge 261 to close off the flow from the line 257, thus preventing the pressure in the timing chamber 154 from affecting the position of the timing piston 156.

It will be apparent that the quantity of fuel metered into the timing chamber 154 determines the position of the plunger 163 and the angle of the cam 164 at the start of the injection stroke and the time of initiation of injection. The time of initiation of injection may therefore be changed by varying the quantity of fuel in the injection chamber, and the timing may be varied between approximately the dashed line **165*a* (FIG. 1) which represents the maximum advance position, and approximately the line 165*b*** which represents the maximum retard position.

Since the size of the orifice 258 is fixed for a given fuel system and the length of time between successive injection strokes depends upon the speed of the engine, the timing is dependent upon the pressure of the fuel in the line 257. In turn, this pressure is dependent upon the pressure of the speed representative signal in the line 236 and upon the load representative pressure in the line 253. Different types of engines have different operating characteristics and may require an advance or a retard of the timing with changing speed and/or load on the engine, or there may be advantages in maintaining the timing substantially constant with engine load. The designer of an engine must consider a number of factors to be optimized, such as power output, economic use of fuel and reduction of engine emissions, each of which may be dependent in part on the timing, and the present system enables the designer to achieve the desired characteristics. In addition, the pressure of the fuel being injected is quite high and the volume of fuel between the chamber 153 and the injectors is relatively large. As the fuel pressure increases under increasing engine load, the timing would normally retard because of the flexing of the fuel system, the fuel actually being slightly compressible at such high pressures. The present arrangement makes it possible to compensate for such flexing and to keep the timing substantially constant, if desired, with increasing load. While in the system illustrated, an increase in either engine speed or load results in an increase in the pressure in the line 257 leading to the timing chamber, and therefore an advance in timing, one or both of the pressure modifying devices 222 or 223 could be arranged to decrease the pressure in the line 257 with an increase in speed or load. In the device 222, for example, this could be accomplished by placing the location of the intake port at the opposite edge of the groove 229 where it would be increasingly closed off by increasing pressure in the line 236.

Figure 5:
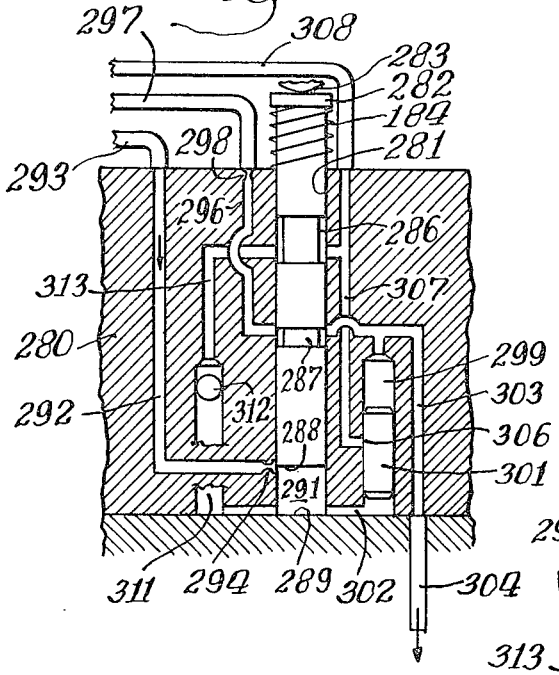
FIG. 5 is a fragmentary view of apparatus in accordance with an alternate form of the invention.
Figure 6:
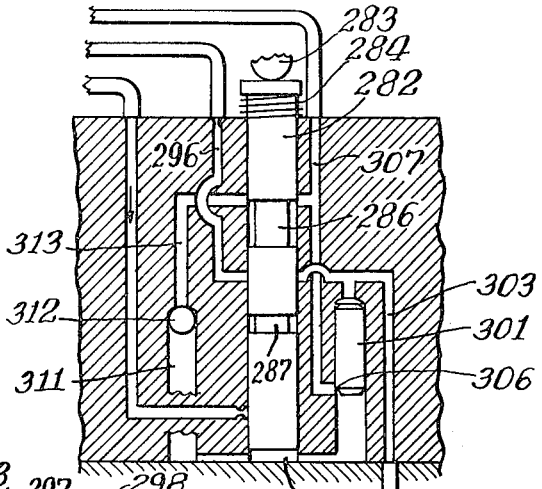
FIGS. 6 and 7 are views of the form of FIG. 5 but showing different positions of the parts.
Figure 7:
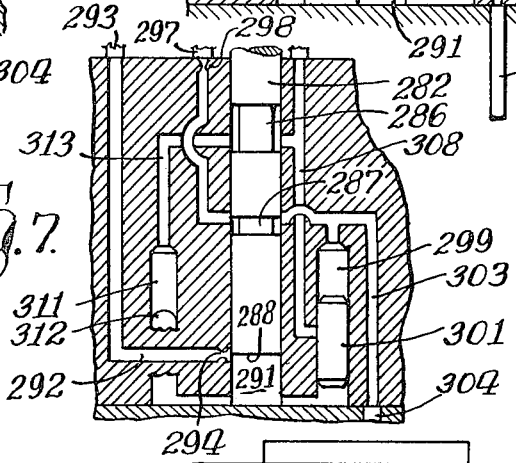

FIGS. 5, 6 and 7 illustrate parts of an alternate form of fuel injection system, including an hydraulic timing arrangement in accordance with the invention. In the form of the invention shown in FIGS. 5, 6 and 7, the plunger and the timing piston are laterally offset or out of alignment with each other, whereas in the previously described form of the invention, they are in line with each other. Further, a metering spring is not provided in the form of the invention shown in FIGS. 5, 6 and 7.

This form of the invention includes a housing 280 having a plunger bore 281 formed therein. A cylindrical plunger 282 is reciprocably mounted in the bore 281 and is connected to be driven in the downward direction by a cam 283 (FIG. 5). The cam 283 is driven by the engine in timed relation with the other engine parts as previously described, and corresponds to the cam 164 illustrated in FIG. 1. A retraction spring 284 is interposed between the housing 280 and the upper end of the plunger 282, and returns the plunger 282 to its retracted position after it has been moved in an injection stroke by the cam 283. The plunger 282 has an elongated upper annular groove 286 and a lower annular groove 287 formed therein. FIG. 5 illustrates the position of the plunger 282 when it is in its completely retracted position at the start of an injection stroke. In this position of the plunger 282, its lower end 288 is spaced upwardly from the bottom 289 of the plunger bore 281, thereby forming a timing chamber 291. A timing fuel passage 292 is formed in the housing 280 and connects with a line 293 which receives timing fuel, the line 293 corresponding to the line 257 in FIG. 1. The line 293 may be connected to receive timing fuel from pressure modifying devices corresponding to the devices 222 and 223 as shown in FIG. 1. A timing orifice 294 is formed in the passage 292 leading to the timing chamber 291, the orifice 294 corresponding to the orifice 258 of FIG. 1. A one-way check valve corresponding to the valve 259 is not required in the form of the invention shown in FIGS. 5 to 7 because of the arrangement of the plunger 282 and the outlet of the passage 292 into the timing chamber 291.

A second or charge passage 296 is formed in the housing 280 and is connected to receive fuel from a fuel supply line 297 which corresponds to the line 182 in FIG. 1. A fuel balancing and feed orifice 298 is formed in the passage 296, which serves to meter the fuel into a charge chamber 299 formed in the housing 280. The charge passage 296 leads through the plunger bore 281 to the upper end of the charge chamber 299, the passage 296 intersecting the bore 281 adjacent the lower groove 287 of the plunger 282. As shown in FIG. 5, the passage 296 has diagonally opposite openings in the plunger bore 281, and when the plunger 282 is in its retracted position, shown in FIG. 5, the two ends of the passage 296 are in flow communication through the groove 287. However, when the plunger 282 moves downwardly in an injection stroke, to the position shown in FIG. 6, the portion of the plunger 282, which is above the groove 287, closes off the passage 296 and thus prevents further flow of the fuel between the passage 296 and the charge chamber 299.

A timing piston 301 is reciprocably mounted in the charge chamber 299, the passage 296 opening into the charge chamber 299 above the upper end of the piston 301. At the opposite end of the piston 301, a fuel passage 302 connects the timing chamber 291 with the charge chamber 299. The upper end of the charge chamber 299 is also connected by a passage 303 to a line 304 which leads to a distributor and a plurality of injectors, which may be similar to the distributor 187 and injectors 15 of the system shown in FIG. 1.

Intermediate the ends of the charge chamber 299 is a spill port 306 which is connected by a passage 307 to a return line 308 corresponding to the passage 176 in FIG. 1. The spill port 306 is located relative to the length of the timing piston 301 and the dimensions of the charge chamber 299 are such that the spill port 306 will be opened by the bottom end of the timing piston 301, as shown in FIG. 6, at the end of an injection stroke when the timing piston 301 is displaced upwardly.

To prevent a pumping action from occurring during reciprocation of the plunger 282, a cylindrical ball chamber 311 is formed in the housing 280 and a free ball 312 is positioned in the chamber 311. The lower end of the chamber 311 is connected to the timing chamber 289, and the upper end of the ball chamber 311 is connected to the return passage 307. A passage 313 connects the upper end of the ball chamber 311 with the return passage 307, and the passage 313 leads through the plunger bore 281. The location at which the passage 313 leads through the plunger bore is adjacent the upper groove 286 of the plunger 282, and the groove 286 is sufficiently elongated that the passage 313 is always open regardless of the vertical position of the plunger 282, as shown in FIGS. 5 and 6.

Considering the operation of the structure shown in FIGS. 5 to 7, FIG. 5 shows the positions of the parts at the end of the metering portion of the cycle and at the start of an injection stroke, FIG. 6 shows the positions at the end of an injection stroke, and FIG. 7 shows the positions at the end of the retraction stroke of the plunger. With specific reference to FIG. 6, the cam 283 has forced the plunger 282, in its injection stroke, to its maximum downward position, such movement forcing the timing piston 301 upwardly to the location where its lower end opens the spill port 306. In addition, the fuel pressure in the timing chamber 291 has moved the ball 312 to the upper end of the ball chamber 311. As shown in FIG. 6, at the upper end of the ball chamber 311, the ball and the chamber are shaped to form a check valve, and the ball closes off the chamber 311 and prevents flow of fuel through the passage 313 to the return passage 307. Continued rotation of the cam 283, as described in connection with the operation of the cam 164 and the plunger 163 in FIG. 1, enables the spring 284 to retract the plunger 282 upwardly to the position shown in FIG. 7. During this movement of the plunger 282, the timing piston 301 cannot move downwardly because fuel cannot flow in the reverse direction through the distributor line 304 and because the passage 296 is closed off by the portion of the plunger 282, which is between the grooves 286 and 287. Therefore, upon upward movement of the plunger 282, the ball 312 is sucked downwardly in the ball chamber 311 from the position shown in FIG. 6 to the position shown in FIG. 7. The upper portion of the ball chamber 311, above the ball 312, is filled with fuel from the return line 308 which flows through the groove 286 and the passage 313.

FIG. 7 shows the positions of the parts at the end of the retraction stroke and at the start of metering. It should be noted that the lower end 288 of the plunger 282 has uncovered or opened the passage 292, and consequently timing fuel flows from the passage 292 into the timing chamber 291. Because of the orifice 294, the quantity of fuel flowing into the timing chamber 291 will again be a function of the pressure of the fuel in the line 293 and the length of time that the fuel flows into the timing chamber 291. The fuel flowing into the chamber 291 moves the ball 312 upwardly in the ball chamber 311 as the timing chamber 291 and the lower end of the ball chamber 311 are filled. In addition to the flow of fuel into the chamber 291, it will be noted that the lower groove 287 has, at the retracted position of the plunger 282 shown in FIG. 5, opened the passage 296 leading from the line 297 to the upper end of the charge chamber 299. Consequently, charge fuel flows into the upper end of the charge chamber 299, moving the timing piston 301 downwardly. The quantity of fuel entering the charge chamber 299 is again dependent upon the pressure of the fuel in the line 297. However, instead of providing a metering spring as in the first described form of the invention, the orifice 298 performs the same function. Due to the orifice 298, the quantity of fuel flowing into the charge chamber 299 is a function of the pressure in the line 297 and the length of time the groove 287 is open to permit the fuel to flow to the chamber 299. At the end of the metering portion of the cycle and at the start of the next injection stroke (shown in FIG. 5), the piston 301 has moved downwardly an amount proportional to the quantity of fuel entering the upper end of the charge chamber 299, and the ball 312 has moved upwardly an amount which is a function of the quantity of fuel entering the chamber 291.

Continued turning movement of the cam 283 causes the plunger 282 to be driven downwardly in the next injection stroke. The initial movement of the plunger 282 results in the charge passage 296 being closed off by the upper end of the lower groove 287 and the timing passage 292 being closed off by the lower end 288 of the plunger 282. As a result, fuel is trapped in the charge chamber 299 and timing fuel is trapped in the timing chamber 291. Continued downward movement of the plunger 282 results in the fuel trapped in the timing chamber 291 forming a hydraulic link and driving the ball 312 upwardly to the upper end of the ball chamber 311. At this point, the ball 312, serving as a one-way check valve, closes the connection of the ball chamber 311 to the return line. The timing fuel in the chamber 291 then drives the timing piston 301 upwardly, forcing fuel from the upper end of the charge chamber 299. Since the portion of the plunger 282 between the two grooves 286 and 287 has closed off the passage 296, the trapped fuel in the charge chamber 299 is forced through the passage 303 and to a distributor connected to receive fuel from the line 304. The distributor serves similarly to the distributor 187 shown in FIG. 1 to distribute the fuel received from the charge chamber 299 sequentially to the injectors of the engine, in proper timed relationship.

For the foregoing system to work satisfactorily, the maximum volume of the timing chamber 291 must be much larger than the volume of the charge chamber 299 above the piston 301 when displaced downwardly, and the ball chamber 311 must be equal in size or greater than the maximum combined volumes of the timing chamber 291 and the charge chamber 299. These dimensional relationships also apply to the other forms of the invention.

Figure 8:
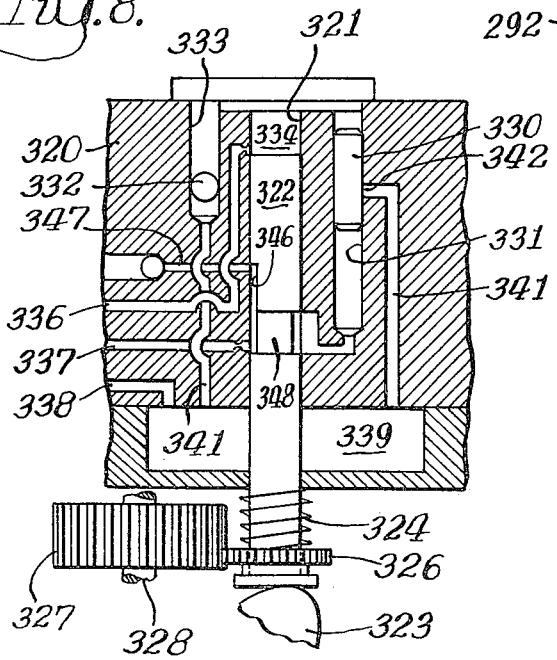
FIGS. 8 and 9 are views similar to FIG. 5 but illustrating still another form of the invention.
Figure 9:
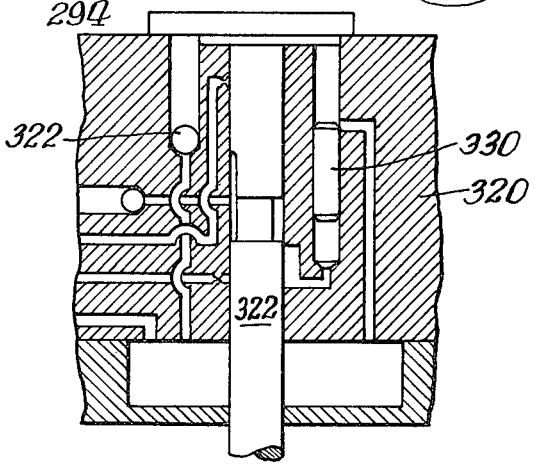

FIGS. 8 and 9 illustrate another form of the invention which is generally similar to that shown in FIGS. 5, 6 and 7 with the exception that the plunger of the system serves as a distributor in addition to pumping the fuel. The structure shown in FIGS. 8 and 9 includes a housing 320 having a plunger bore 321 formed therein, and a plunger 322 is reciprocably mounted in the bore 321. The plunger 322 is driven in a reciprocating motion by a cam 323, and a compression spring 324 is connected to the plunger 322 and to the housing 320 for retracting the plunger 322 at the end of an injection stroke. In addition to moving in a reciprocating motion, the plunger 322 is also connected to be rotated by, in the present example, a gear drive including a gear 326 secured to the plunger 322 adjacent the cam 323, and a drive gear 327 which is connected by a shaft 328 to be driven by the engine in timed relation with the rotation of the cam 323.

The system shown in FIG. 8 further includes the following parts which correspond to parts illustrated in FIGS. 5, 6 and 7. These parts include a timing piston 330 which reciprocates in a charge chamber 331, a ball 332 which reciprocates in a ball chamber 333, a timing chamber 334 formed at the upper end of the plunger 322, a timing passage 336 which receives fuel from pressure modifying devices and corresponds to the passage 292 in FIG. 5, a charge passage 337 which corresponds to the passage 296 in FIG. 5, and a return passage 338 which corresponds to the passage 307 in FIG. 5. Both the charge and timing passages have orifices formed therein. The return passage 338 leads to the cavity 339 formed in the housing 320, the ball chamber 333 being connected to the cavity 339 by a passage 341 and the charge chamber 331 being connected to the cavity 339 by a passage 341, the passage 341 terminating in a spill port 342. A difference between the structure shown in FIG. 8 and that shown in FIG. 5 is that the passage 341 does not lead through the plunger bore as is the case in FIG. 5. Any fuel flowing through the return passage 341 flows to the cavity 339 and then through the return passage 338 to the fuel supply tank as previously described.

The distributor is formed as part of the plunger 322, the distributor including an axially elongated slot 346 formed in one side of the plunger 322, and a plurality of passages 347 formed in the housing 320. The passages 347 (only one shown in FIG. 8) communicate with the plunger bore 321 and extend radially outwardly therefrom and are spaced at approximately equal angular distances, one passage 347 leading to each of the injectors of the engine. The slot 346 leads to an annular groove 348 formed in the plunger 322. At the start of each injection stroke, the lower edge of the groove 348 cuts off or closes the charge passage 337, but it will be noted that the groove 348 plus the slot 346 maintain flow communication from the lower end of the charge chamber 331, through the groove 348 and the slot 346 to the passage 347 leading to one of the fuel injectors. Consequently, during the time that the plunger 322 is being forced upwardly in the passage 321 by the cam 323 (FIG. 9), the fuel in the charge chamber 331 is displaced and forced to an injector, and by the time the plunger 322 has retracted to the position shown in FIG. 8 and after metering of the fuel is completed for the next injection stroke, the plunger 322 has been rotated by the gears 326 and 327 so that the slot 346 is in flow communication with the next adjacent passage 347 leading to another injector. As previously mentioned, the gears 326 and 327 rotate the plunger 322 in timed relation with its reciprocation such that, in each injection stroke of the plunger 322, the slot 346 is in flow communication with one of the passages 347.

Figure 11:
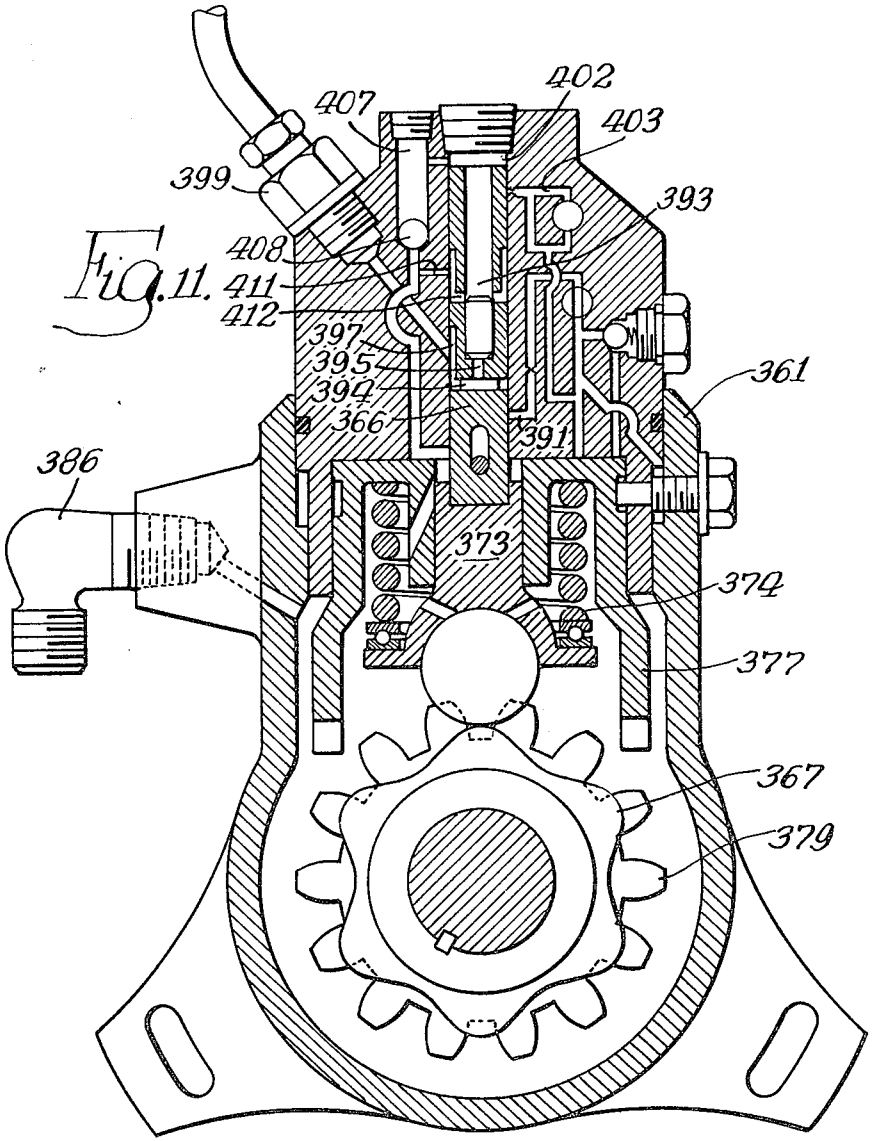
FIGS. 10 and 11 are fragmentary views of apparatus in accordance with still another form of the invention.
Figure 10:
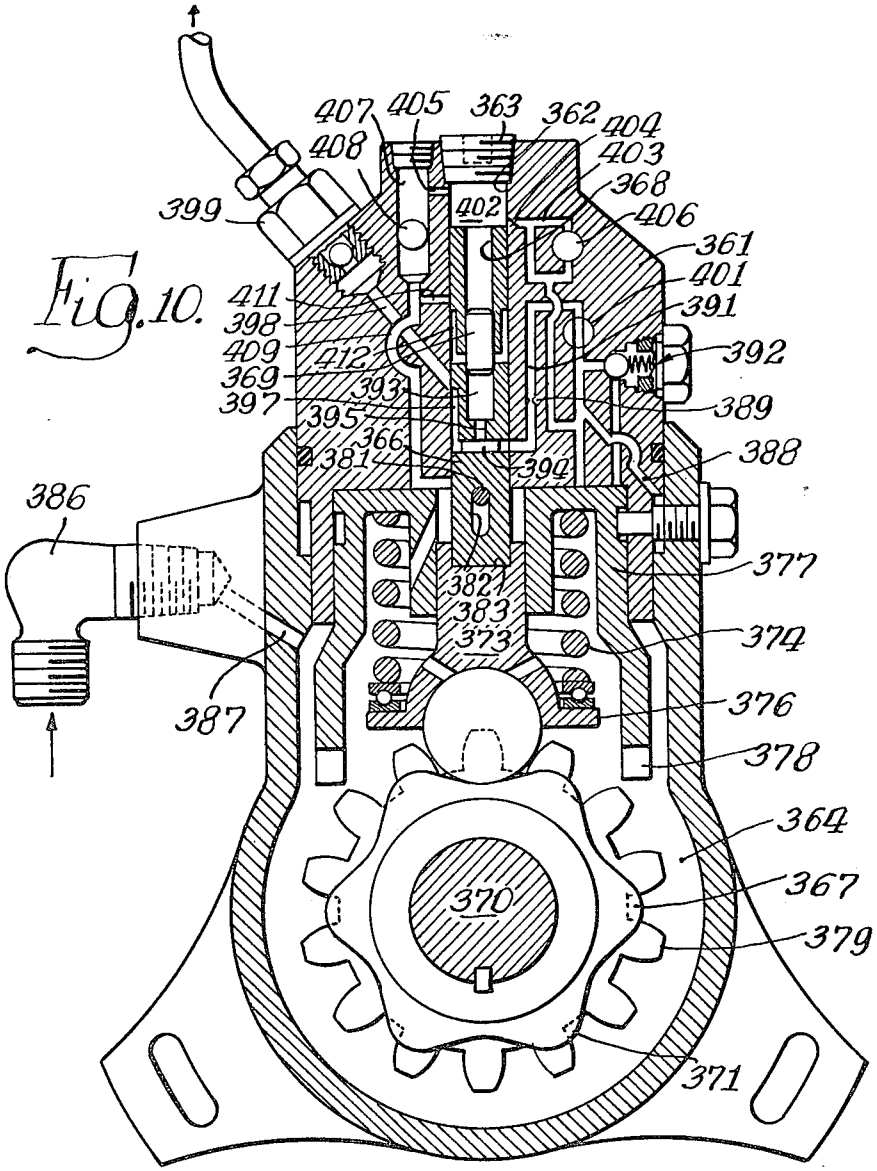

FIGS. 10 and 11 illustrate another form of the invention which is generally similar to that shown in FIGS. 8 and 9 in that the plunger is rotated to thereby serve as a distributor but differing in that the charge piston is reciprocably mounted within a hole in the plunger rather than being offset to one side of the plunger. With reference to FIGS. 10 and 11, which also show more structural details of such a construction, there is shown a housing 361 having a cylindrical plunger bore 361 formed therein, the plunger bore 362 being closed or capped at its upper end by a removable plug 363, and the plunger bore 362 extending downwardly to an enlarged cavity 364 formed in the housing. A plunger 366 is reciprocably mounted in the plunger bore 362 and is driven in a reciprocating motion by a cam 367. The plunger 366 has an axially extending opening or hole 368 formed therein, and a charge piston 369 is reciprocably mounted in the hole 368.

The cam 367 which drives the plunger 366 is mounted on a cam shaft 370 and turns with it in timed relation with the movement of the pistons of the engine. In the present instance, the cam 367 has six lobes 371 which engage a cam follower 372 fastened to a cam follower piston 373. The lobes 371 drive the plunger 366 upwardly as the shaft 370 turns, and a retraction spring 374 is provided to return the plunger 366 and the piston 373 downwardly at the end of an injection stroke. The retraction spring 374 is positioned between a flange 376 formed on the lower end of the piston 373, and the interior of an inverted cup-shaped gear member 377. The gear member 377 is mounted for rotation relative to the housing 361 and gear teeth 378 are formed on its rim. A drive gear 379 is also fastened to and rotates with the cam shaft 370, the gear 379 meshing with the gear teeth 378 of the member 377. Consequently, when the cam shaft 370 turns, the gear 379 turns the gear member 377 on the axis of the plunger 366. The gear member 377 is connected to rotate the plunger 366 but permits the plunger 366 to reciprocate relative to the member 377. This connection is formed by a pin 381 which is connected to the gear member 377 and extends radially through an axially elongated slot 382 formed in the lower end of the plunger 366. Consequently, the pin 381 causes the plunger 366 to turn with the gear member 377, but since the slot 382 is axially elongated, the plunger 366 is able to reciprocate along its axis relative to the gear member 377. The lower end of the plunger 366 is also rotatably mounted within a cup shaped recess 383 formed in the upper end of the piston 373 and is able to rotate in the recess 383.

Fuel enters the housing 361 through a coupling 386 and flows through a passage 387 to the interior cavity 364 of the housing 361. In the structure illustrated in FIGS. 10 and 11, a fuel pump (not shown) corresponding to the pump 22 is also mounted on the shaft 370 and pumps the fuel from the cavity 364 to the pump-distributor assembly. Since the fuel pump and the passage leading to and from it do not form part of the present invention, they are not illustrated. Fuel from the output of the fuel pump flows through a passage 388, through an orifice 389 in the passage 388, and through a charge passage 391. A pressure regulator 392 is preferably provided in the passage 391 to regulate the passage of the fuel flowing to a charge chamber 393 which is formed in the axial hole 368, the chamber 393 being between the lower end of the timing piston 369 and the bottom end of the hole 368. The passage 391 leads from the orifice 389 to an annular groove 394 formed in the plunger 366 and axially of the plunger 366 through a hole 395 from the groove 394 to the charge chamber below the bottom end of the piston 369. The annular groove 394 also connects with an axially extending distributor slot 397 which extends upwardly on the outside of the plunger 366 to a passage 398 which leads to a coupling 399. A plurality of such passages 398 (only one being shown) are formed at radially equally spaced distances around the bore 366 and connect the distributor slot 397 with an equal number of injectors (not shown). It will be apparent that the slot 397 and the coupling 399 correspond to the slot 346 and the passage 347 of FIG. 8.

In addition to the pressure regulator 392, a throttle and a shutdown valve, indicated generally at 401, may also be provided in the charge passage 391 to control the flow of fuel to the charge chamber 393.

Between the upper end of the plunger 366 and the cap 363 is formed a timing chamber 402 which is in flow communication with the portion of the hole 368 above the upper end of the piston 369. Fuel flows into the timing chamber 402 through a timing passage 403 which receives fuel from the line 388 ahead of the orifice 389. An orifice 404 is provided in the passage 403 and apparatus 406 is preferably provided to control the pressure of the timing fuel flowing to the chamber 402. The timing chamber 402 is also in flow communication through a passage 405 with the upper end of the ball chamber 407 having a free ball 408 located therein, the chamber 407 and ball 408 corresponding to the chamber 333 and the ball 332 shown in FIG. 8. The lower end of the ball chamber 407 is connected by a drain passage 409 to the interior of the housing cavity 364.

Also connected to the drain passage 409 is a spill passage 411 which extends between the passage 409 and the plunger bore 368. An annular spill groove 412 is formed in the plunger 366 and connects with the interior of the hole 368, the passage 412 opening into the hole 368 at a location where it will be opened by the timing piston 369 at the end of its movement in an injection stroke of the plunger, this position being illustrated in FIG. 11.

Considering the operation of the structure shown in FIGS. 10 and 11, FIG. 10 illustrates the position of the parts at the end of the metering portion of the cycle and at the start of an injection stroke, and FIG. 11 illustrates the positions of the parts at the end of the injection stroke. During the time that the plunger 366 is in the downward position shown in FIG. 10, fuel flows into the timing chamber 402 and fuel flows into the charge chamber 393. The quantity of fuel flowing into each of these chambers of course depends upon the pressure of the fuel supplied thereto, as described in connection with the previous embodiments of the invention. When the rotation of the cam 367 drives the piston 373 and the plunger 366 upwardly, the upper end of the plunger 366 closes off the inlet of the timing passage 403 and the groove 394 moves out of communication with the charge passage 391. The ball 408 is moved downwardly until it meets and seals the lower end of the chamber 407, thus trapping fuel in the timing chamber 402 and in the charge chamber 393. Continued upward movement of the plunger 366 results in fuel being forced from the charge chamber 393 through the passage 395, the groove 394, the slot 397, the passage 398 and out through the coupling 399 to an injector connected to the coupling 399. Injection continues until the piston 369 has moved, relative to the plunger 366, sufficiently far that its upper end opens the spill passage 411 as shown in FIG. 11. Continued turning movement of the cam 367 then permits the retraction spring 374 to move the piston 373 and the plunger 366 downwardly. During this movement the gear 379 continues to turn the gear member 377 and the plunger 366, so that by the time the cam 367 has rotated to the point where it forces the plunger 366 upwardly once again, the distributor slot 397 formed in the plunger 366 has turned to the angular position where it is in flow communication with the next adjacent passage 398 and coupling 399 (not shown). Thus, the fuel is distributed sequentially to the injectors connected to the couplings 399 as the plunger 366 is rotated and also driven in reciprocating motion.

Figure 13:
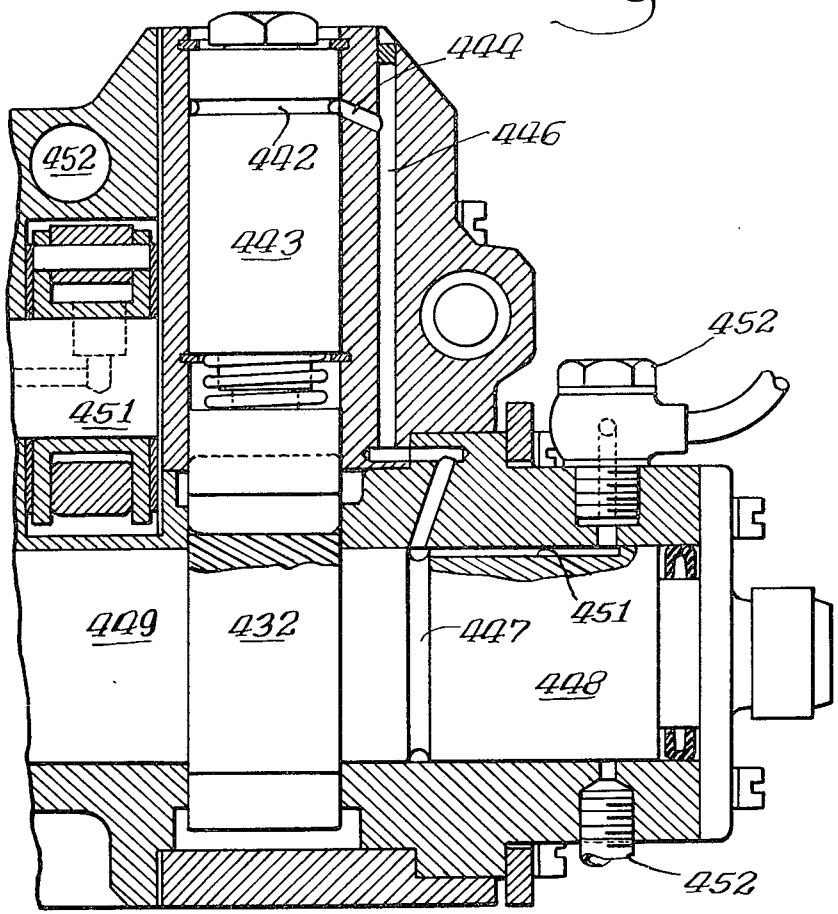
FIG. 13 is a fragmentary sectional view taken on the line 13—13 of FIG. 12.
Figure 12:
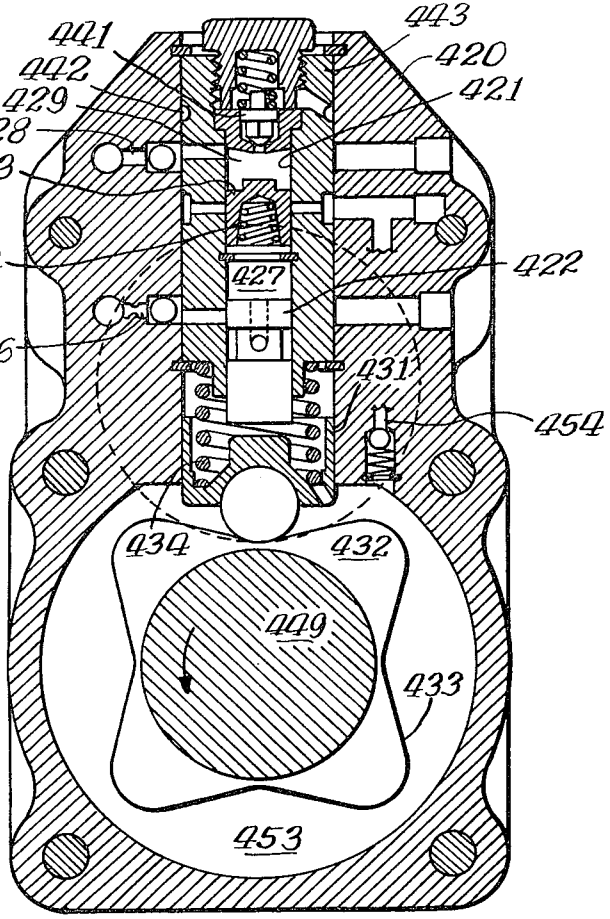
FIG. 12 is a fragmentary view similar to FIG. 10 but illustrating still another form of the invention.

In FIGS. 12 and 13 is illustrated a form of the invention which is generally similar to that shown in FIG. 1, but illustrates the details of the structure and another form of distributor. Since the structure shown in FIGS. 12 and 13 is generally similar to that shown in FIG. 1, not all of the parts are illustrated and described in detail. With reference to FIG. 12, the structure includes a housing 420 having a plunger bore 421 formed therein, a plunger 422 being reciprocably mounted in the plunger bore. A timing piston 423 and a metering spring 424 are also mounted in the plunger bore 421. A passage 426 carries timing fuel to a timing chamber 427, and a charge passage 428 carries fuel to a charge chamber 429. The plunger 422 is connected to a cam follower 431 which is driven by a cam 432 having four lobes 433. The cam follower 431 is generally cup-shaped and a spring 434 connects the follower 431 with the plunger housing 420. The spring 434 holds the follower 431 on the surface of the cam 432, but when the follower 431 is forced upwardly by one of the lobes 433, it engages the lower end of the plunger 422 and forces it upwardly. However, when the follower 431 moves downwardly under the action of the spring 434 in the spaces between adjacent cam lobes 433, the plunger 422 initially remains in its upwardly displaced position and it is not returned to its downwardly spaced position until timing fuel flows into the timing chamber 427 and moves the plunger 422 downwardly, similar to the system shown in FIG. 1.

During an injection stroke of the plunger, the plunger 422 moves upwardly and traps fuel in the charge chamber 429 as previously explained, and this fuel is forced out of the charge chamber 429 through a delivery or outlet valve 441. This fuel flows through the valve 441 and into an annular groove 442 (FIG. 13) formed in the outer surface of a sleeve 443 of the housing 420, another passage 444 leading from the valve 441 to the groove 442. Fuel flows from the groove 442 through a passage 446 to an annular intake groove 447 formed in the outer periphery of a distributor rotor 448 (FIG. 13). The rotor 448 is connected to be driven by a cam shaft 449 which also drives the cam 432. The groove 447 is connected to an axially extending slot 451 formed in the outer surface of the rotor 448. As the rotor 448 turns, the slot 451 is successively in flow communication with a plurality of couplings 452, only two of the couplings being shown in FIG. 13. Since the cam 432 has four lobes 433, there would be four injection strokes of the plunger 422 for each revolution of the cam shaft 449, and accordingly there would be provided a total of four couplings 452 spaced at 90° intervals around the rotor 448. The slot 451 is located relative to the four lobes 433 of the cam 430 such that the slot 451 is in flow communication with one of the couplings 452 during each of the injection strokes of the plunger 422. The couplings 452 are of course connected to injectors of the engine. Consequently, in each injection stroke of the plunger, fuel is forced through the passage 446, the annular groove 447, the slot 451, and out of one of the four couplings 452 to an injector.

The passages 426 and 428 are connected to receive fuel from pressure regulating devices as previously explained. Such pressure regulating devices are shown partially in FIG. 13 and may consist of a governor mechanism 451 and a timing control device 452. The cavity 453 which contains the cam 432 is connected to a fuel supply tank (not shown) and is normally at atmosphere pressure. A return passage 454 is connected to the cavity 453 and connects with the timing and charge chambers as previously explained.

In the previously described forms of the invention, the pump and the apparatus for adjusting the timing of injection by varying the length of a hydraulic link are included in a pump-distributor which is separate from an injector of the engine. In the two forms of the invention shown in FIGS. 14 through 17, a pump and a variable length hydraulic link are provided in an injector.

Figures 14, 15, 16, 17:
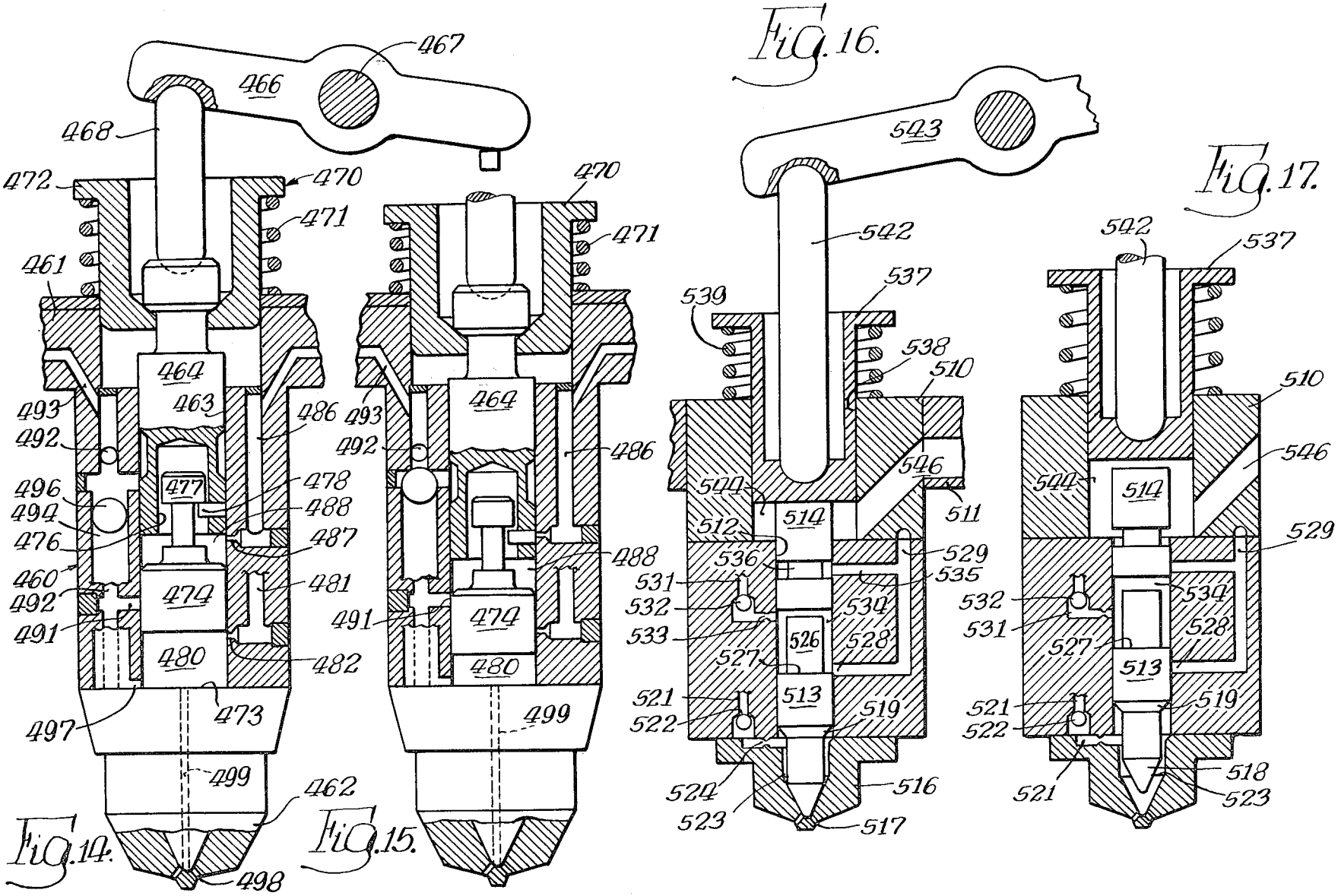
FIG. 14 is an illustration of an injector embodying the invention.
FIG. 15 is another view of the injector shown in FIG. 14 but illustrating another position of the parts.
FIG. 16 is an illustration of another form of injector embodying the invention.
FIG. 17 is another view of the injector shown in FIG. 16 but illustrating another position of the parts.

The injector shown in FIGS. 14 and 15 comprises an injector housing or body 460 which is mounted in the head 461 of an engine, the lower end or nozzle 462 of the injector projecting into the interior of a combustion chamber. The foregoing structure is generally well known in the art and therefore is not illustrated in detail. The injector body 460 has a plunger bore 463 formed therein, and a plunger 464 is reciprocably mounted in the plunger bore 463. A rocker arm 466 is pivotally mounted on a pin 467, and a link 468 connects one end of the rocker arm 466 with the upper end of the plunger 464 in order to move the plunger 464 in a reciprocating movement during operation, the rocker arm usually being pivoted by a cam shaft (not shown) of the engine. A cup-shaped retraction member 470 is positioned around the upper end of the plunger 464, a hole being formed through the bottom of the member 470 and the plunger 464 extending through this hole. A compression spring 471 is positioned around the retraction member 470 between a flange 472 and the engine block 461 in order to retract the plunger 464 after an injection stroke.

Positioned between the bottom of the plunger 464 and the lower end 473 of the plunger bore 463 is a timing piston 474. In the present illustration, the timing piston 474 is connected by a lost motion type of connection to the plunger 464. An axially extending hole 476 is formed in the lower end of the plunger 464, and a knob 477 on the upper end of the timing piston 474 extends into the opening 476. A radially extending pin 478 is connected to the lower end of the plunger 464 and extends under the knob 477, thereby connecting the timing piston 474 to the plunger 464 but permitting axial movement of the timing piston 474 relative to the plunger 464.

A plurality of fluid passages are also formed in the injector body 460, these passages including a charge passage 481 which carries fuel to a charge chamber 480 located below the bottom end of the timing piston 474. An orifice or flow restriction 482 is formed in the charge passage 481 in order to meter the fuel into the charge chamber 480 and thereby make the quantity of fuel flowing into the charge chamber 480 a function of the pressure of the fuel in the line passage 481. In addition to the charge passage 481, there is also provided a timing passage 486 which leads through another restriction or orifice 487 to a timing chamber 488 which is formed between the timing piston 474 and the lower end of the plunger 464. The charge and timing passages 481 and 486 of course receive fuel from fuel pressure regulating devices as previously explained. In addition to the supply passages, there is also provided a spill port 491 which opens into the plunger bore 463 at a location where it will be opened by the upper end of the main body of the timing piston 474 at the completion of the injection stroke, and spill fuel from the timing chamber 488. The spill port 491 leads to a spill passage 492 and to a return line 493 which is at substantially atmospheric pressure. In addition, a ball chamber 494 is provided, having a free ball 496 therein. The upper end of the ball chamber 494 is connected to the return line 493, and the lower end of the ball chamber 494 is connected by a passage 497 to the charge chamber 480.

The charge chamber 480 is of course connected by a passage 499 to spray holes 498 formed in the nozzle 462. A conventional closed nozzle or open nozzle type of construction (not shown) may be utilized.

Considering the operation of the injector shown in FIGS. 14 and 15, FIG. 14 shows the positions of the parts at the end of the metering portion of the cycle and at the start of the injection stroke, and FIG. 15 illustrates the positions of the parts at the end of the injection stroke. With regard to FIG. 14, during the time that the plunger 464 is displaced upwardly, fuel flows through the charge orifice 482 into the charge chamber 480, and of course the amount of fuel flowing into the charge chamber 480 is dependent upon the pressure of the fuel in the line 481. As fuel flows into the charge chamber 481, it displaces the ball 496 upwardly in the passage 494 as the charge chamber 480 fills. In addition, fuel flows through the timing orifice 487 into the timing chamber 488, and the quantity of fuel flowing into the timing chamber is dependent upon the pressure of the fuel in the timing passage 486.

When the plungger 464 moves downwardly in the injection stroke, the lower end of the plunger 464 closes off the timing orifice 487, thus trapping fuel in the timing chamber 488. The quantity of trapped fuel determines the length of the hydraulic link between the plunger 464 and the timing piston 474. As soon as the lower end of the plunger 464 meets the solid fuel in the timing chamber, it drives the timing piston 474 downwardly, closing off the charge orifice 482 and exerting pressure on the charge to cause the ball 496 to move upwardly to the upper end of the ball chamber 494. When it meets the upper end of the chamber 494, it acts as a one-way check valve and blocks further flow of fuel to the return passage 493 (FIG. 15). The trapped fuel in the charge chamber 481 then is forced through the passage 499 and out the spray holes 498, and is sprayed into the engine combustion chamber. The time of the initiation of the injection of course depends upon the quantity of the fuel in the timing chamber 488 and may be changed by varying the pressure in the fuel line 486 as previously described. After the plunger 464 and the timing piston 474 have moved downwardly to the position shown in FIG. 15, the upper end of the timing piston 474 opens the spill port 491, thereby spilling fuel from the timing chamber 488 through the passage 492 and to the return line 493. Continued downward movement of the plunger 460 simply squeezes fuel out of the timing chamber 488, and due to the resultant drop in pressure in the charge chamber 480, injection abruptly terminates. At the end of the injection stroke, the cam drive for the rocker arm 466 turns to the point where the retraction spring 471 is able to lift the cup-shaped member 470 and the plunger 464 upwardly to the position shown in FIG. 14, and metering of fuel into the timing and charge chambers once again commences.

FIGS. 16 and 17 illustrate another form of injector which operates generally similar to the injector shown in FIGS. 14 and 15, but does not require a ball chamber and free ball therein. The injector shown in FIGS. 16 and 17 includes an injector body 510 which is fastened in the head 511 of an internal combustion engine. A plunger bore 512 is formed in the injector body 510, and a timing piston 513 is reciprocably mounted in the lower end of the bore 512. A plunger 514, which is separate from the piston 513, is also reciprocably mounted in the plunger bore 512 above the piston 513. At the lower end of the body 510 is formed a nozzle 516 having a plurality of spray holes 517 formed therein, and the piston 513 includes a valve portion 518 which extends downwardly into the nozzle 516. Formed between the central portion of the piston 513 and the valve part 518 is a shoulder 519, and a charge passage 521 is formed in the body 511 and opens into a charge chamber 523 formed by the bore 512 below the shoulder 519. A one-way check valve 522 is mounted in the charge passage 521, which permits the flow of fuel only in the direction of the charge chamber 523. Further, an orifice 524 is provided in the charge passage 521 to restrict the flow of fuel and thereby make the quantity of fuel flowing into the charge chamber 523 a function of the pressure of the fuel in the passage 521. Formed on the upper end of the piston 513 is an axially located pin 526 which extends upwardly in the plunger bore 512. A shoulder 527 is formed at the location where the pin 526 adjoins the center portion of the piston 512, this shoulder, when the piston 513 is downwardly displaced at the end of an injection stroke, opening a spill passage 528. The passage 528 leads to a suitable return or drain line 529 formed in the injector body 510 and the block 511.

In addition to the foregoing passages, there is also provided a timing passage 531 which receives timing fuel from suitable pressure modifying devices as previously described. The timing passage 531 has a one-way check valve 532 and an orifice 533 formed therein. The timing passage 531 opens into a timing chamber 534 formed by the space between the piston 513 and the plunger 514.

The plunger 514 as previously mentioned is located above the plunger 513 and has an annular groove 536 formed in its outer periphery. The purpose of the groove 536 is to collect any fuel leaking from the timing chamber 534 upwardly around the plunger 513. The annular groove 536 is connected by a passage 535 to the return line 529. The upper end of the plunger 514 is adapted to be engaged and driven downwardly by a cup-shaped member 537 which reciprocates in an opening 538 formed in the plunger body 510. The member 537 is urged upwardly by a retraction spring 539 which is seated between an upper flange 541 formed on the member 537 and the upper side of the plunger body 510. The member 537 may be moved downwardly by a link 542 and a rocker arm 543, similar to the corresponding parts of the form of the injector shown in FIGS. 13 and 14.

Considering the operation of the injector shown in FIGS. 16 and 17, the positions of the parts shown in FIGS. 16 illustrate the position of the injector at the end of an injection stroke, and FIG. 17 illustrates the position of the parts at the end of the metering portion of the cycle and at the beginning of an injection stroke. Assume that the parts in the position shown in FIG. 16 and that the cam which is connected to drive the rocker arm 543 has turned to enable the retraction spring 539 to move the member 537 upwardly to the position shown in FIG. 17. To prevent a suction action from occurring when the member 537 moves upwardly, the space 544 between the lower end of the member 537 and the upper end portion of the plunger 514 is connected by a passage 546 formed in the injector body 510 and the engine block 511 to a supply of fluid at atmospheric pressure. This fluid may be lubricating oil which will provide the necessary lubrication. During the operation of the injector, this oil flows into and out of the space 544 as the member 537 moves upwardly and downwardly. As soon as the member 537 starts to move upwardly to the position shown in FIG. 17, the release of pressure on the upper end of the plunger 514 enables timing fuel to flow through the timing passage 531 into the timing chamber 534 and move the plunger 514 upwardly. Since the oil in the chamber 544 is at atmospheric pressure, there is little or no resistance to the flow of fuel into the timing chamber and movement of the plunger 514 upwardly. At the same time, charge fuel flows through the charge passage 521 into the charge chamber 523 below the shoulder 519 of the piston 513. As the fuel flows into the charge chamber 523, it moves the plunger 513 upwardly, and closes off the spill passage 528. The flow of fuel through the passages 531 and 521 continues during the metering portion of the injector cycle and, as previously mentioned, the quantity of fuel flowing into the chambers 523 and 524 is a function of the pressures of the fuel. At the end of the metering portion of the cycle, the parts of the injector are in approximately the position shown in FIG. 17. The cam drive for the rocker arm 543 then drives the member 537 downwardly. The member 537 squeezes some of the oil out of the space 544 through the passage 546 until the lower end of the member 537 meets the upper end of the plunger 514, and it then drives the plunger 514 downwardly. The resulting increase in pressure in the chambers 523 and 534 results in closing of the check valves 522 and 532, thereby trapping fuel in the timing chamber 534 and in the charge chamber 523. The fuel in the timing chamber 534 serves a substantially solid hydraulic link which connects the plunger 514 with the piston 513 and drives the piston 513 downwardly. The downward movement of the piston 513 forces fuel from the charge chamber 523, out of the spray holes 517 and into a combustion chamber of the engine. Injection continues until the upper edge 527 of the center portion of the piston 513 opens the spill passage 528 (FIG. 16). As the member 537 and the plunger 514 continue to move downwardly, a portion of the fuel in the timing chamber 534 is squeezed out through the return passage 529, thereby relieving the downward driving force on the piston 513 and terminating injection. The cam drive continues to turn and it enables the retraction spring 539 to return the member 537 to the position shown in FIG. 17 and the metering portion of the next cycle commences again.

During injection, any leakage of fuel from the timing chamber 534 upwardly around the plunger 514 is collected in the annular groove 536 and flows out of the injector through the return passage 529. A similar arrangement is also provided in the injector shown in FIGS. 14 and 15.

The fuel supplied to the timing and charge chambers of the injectors shown in FIGS. 14 to 17 may be received from a fuel supply including pressure modifying devices as shown in FIG. 1. A pump-distributor assembly would not of course be required with the injectors. The charge chamber would be connected to receive fuel from the shut down valve 42, and the timing chamber would be connected to receive fuel from the pressure modifying devices 222 and 223.

The forms of the pump-distributor and the forms of the injectors shown in FIGS. 14 to 17 are advantageous in that the timing may be readily adjusted by varying the pressure of the fuel supplied through the timing passages to the timing chamber, this pressure changing the quantity of fuel in the timing chamber. This quantity of fuel determines the length of the hydraulic link formed by the trapped fuel in the timing chamber and, as previously described, this quantity of fuel controls the time of initiation of injection. The time of termination of injection is always constant because it is determined by the time that the spill passage is opened. The invention has further advantages in that the length of the hydraulic link may be quickly changed from one cycle to the next. This is due to the fact that the quantity of fuel in the timing chamber is exhausted at the end of each injection stroke and it is replenished before each stroke. Consequently, the timing may be made quickly responsive to changes in the engine operating parameters. The forms of the injection are further advantageous in that they do not require complicated mechanisms for adjusting the timing, which are subject to wear and deterioration during the operation of the engine. The charge quantity and the timing may be simply adjusted by varying the pressure of the fuel supplied to the chambers as described in connection with the form of the injector shown in FIG. 1.

While the invention has been described in connection with a system wherein the engine parameters which are sensed and used to control timing are speed and load, it should be recognized that one or the other of these parameters alone could be used to control timing or that other parameters could be utilized. It should also be recognized that apparatus other than that shown in FIG. 1 could be used to provide control pressure representative of the selected engine parameters. In the system shown in FIG. 1, the fuel pressure at the output of the throttle is representative of the engine load because the throttle is normally manually adjusted to increase the fuel pressure as the load on the engine increases. The pressure in the line 99 of FIG. 1 is representative of engine speed because the fuel pump 22 and the centrifugal weights 63 and 64 are driven by the engine.

What is claimed is:

1. Fuel supply apparatus for controlling the time of injection of fuel in a compression-ignition engine, comprising a housing, a charge chamber and a timing chamber formed in said housing, said chambers being in pressure communication, a timing piston reciprocably mounted in said charge chamber and separating said charge and timing chambers, a plunger reciprocably mounted in said housing and movable in said timing chamber, charge fuel flow passage means in said housing for supplying charge fuel to said charge chamber, timing fluid flow passage means in said housing for supplying timing fluid to said timing chamber, variable means for supplying timing fluid to said timing fluid flow passage means, said variable means being variable through a plurality of steps to vary the pressure of said timing fluid, the quantity of said timing fluid flowing into said timing chamber being a function of the pressure of the timing fluid and said quantity forming a hydraulic link between said plunger and said piston, a fuel outlet passage from said charge chamber, said plunger being movable in an injection stroke to move said link and said timing piston through said charge chamber and thereby force said charge fuel out of said charge chamber through said outlet passage, and means for automatically releasing the pressure of said timing fluid in said timing chamber after each injection stroke.

2. Fuel supply apparatus for controlling the time of injection of fuel in a compression-ignition engine, comprising a housing, a charge chamber and a timing chamber formed in said housing, said chambers being in fuel flow communication, a timing piston reciprocably mounted in said charge chamber and separating said charge and timing chambers, a plunger reciprocably mounted in said housing and movable in said timing chamber, charge fuel flow passage means in said housing for supplying charge fuel to said charge chamber, timing fluid flow passage means in said housing for supplying timing fluid to said timing chamber, the quantity of fluid flowing into said timing chamber being a function of the pressure of the timing fluid and said quantity forming a hydraulic link between said plunger and said piston, and a fuel outlet passage from said charge chamber, said plunger being movable in an injection stroke to move said link and said timing piston through said charge chamber and thereby force said charge fuel out of said charge chamber through said outlet passage, and means for spilling fluid from said timing chamber at approximately the end of each injection stroke, said fluid in said timing chamber being replenished after each injection stroke.

3. Fuel supply apparatus for controlling the time of injection of fuel in a compression-ignition engine, comprising a housing, a charge chamber and a timing chamber formed in said housing, said chambers being in fuel flow communication, a timing piston reciprocably mounted in said charge chamber and separating said charge and timing chambers, a plunger reciprocably mounted in said housing and movable in said timing chamber, charge fuel flow passage means in said housing for supplying charge fuel to said charge chamber, timing fluid flow passage means in said housing for supplying timing fluid to said timing chamber, the quantity of fluid flowing into said timing chamber being a function of the pressure of the timing fluid and said quantity forming a hydraulic link between said plunger and said piston, and a fuel outlet passage from said charge chamber, said plunger being movable in an injection stroke to move said link and said timing piston through said charge chamber and thereby force said charge fuel out of said charge chamber through said outlet passage, and a spill passage formed in said housing and leading to said timing chamber, said spill passage normally being closed but being opened by movement of said timing piston at approximately the end of each injection stroke, thereby spilling said fluid and terminating injection.

4. Fuel supply apparatus for controlling the time of injection of fuel in a compression-ignition engine, comprising a housing, a charge chamber and a timing chamber formed in said housing, said chambers being in fuel flow communication, a timing piston reciprocably mounted in said charge chamber and separating said charge and timing chambers, a plunger reciprocably mounted in said housing and movable in said timing chamber, charge fuel flow passage means in said housing for supplying charge fuel to said charge chamber, timing fluid flow passage means in said housing for supplying timing fluid to said timing chamber, the quantity of fluid flowing into said timing chamber being a function of the pressure of the timing fluid and said quantity forming a hydraulic link between said plunger and said piston, and a fuel outlet passage from said charge chamber, said plunger being movable in an injection stroke to move said link and said timing piston through said charge chamber and thereby force said charge fuel out of said charge chamber through said outlet passage, and a distributor connected to receive fuel flowing from said fuel outlet passage, said distributor being adapted to be connected to a plurality of fuel injectors and to deliver fuel sequentially to said injectors.

5. Apparatus as in claim 4, and further including means connected to and driving said plunger and said distributor in synchronism with said engine.

6. Apparatus as in claim 1, wherein said housing forms part of an injector, and further including an injector nozzle connected to receive fuel from said outlet passage.

7. Fuel supply apparatus for controlling the time of injection of fuel in a compression-ignition engine, comprising a housing, charge chamber and a timing chamber formed in said housing, said chambers being in fuel flow communication, a timing piston reciprocably mounted in said charge chamber and separating said charge and timing chambers, a plunger reciprocably mounted in said housing and movable in said timing chamber, charge fuel flow passage means in said housing for supplying charge fuel to said charge chamber, timing fluid flow passage means in said housing for supplying timing fluid to said timing chamber, the quantity of fluid flowing into said timing chamber being a function of the pressure of the timing fluid and said quantity forming a hydraulic link between said plunger and said piston, and a fuel outlet passage from said charge chamber, said plunger being movable in an injection stroke to move said link and said timing piston through said charge chamber and thereby force said charge fuel out of said charge chamber through said outlet passage, and fluid pressure control means connected to said timing passage means for adjusting the pressure of said fluid in accordance with at least one engine parameter.

8. Apparatus as in claim 7, wherein said parameter is the engine speed.

9. Apparatus as in claim 7, wherein parameter is the engine load.

10. Apparatus as claim 7, wherein the pressure of said fluid is adjusted in accordance with both engine load and engine speed.

11. Fuel supply apparatus for pumping fuel in a fuel system of a compression ignition engine, comprising a pump body having a charge chamber and a timing chamber formed therein, a timing piston reciprocably mounted in said charge chamber and separating said charge and timing chambers, a plunger reciprocably mounted in said body and movable in said timing chamber, timing fuel flow passage means in said housing for carrying timing fuel from a variable pressure supply to said timing chamber, said variable pressure supply being responsive to at least one engine operating parameter, charge fuel flow passage means in said body for carrying charge fuel from a fuel supply to said charge chamber, means for reciprocating said plunger in injection and retraction strokes in timed relation with the operation of said engine, the quantity of timing fuel in said timing chamber forming a hydraulic link between said plunger and said piston during said injection stroke, fuel outlet passage means connected to said charge chamber for carrying fuel from said charge chamber during said injection stroke, means for closing said charge and timing passage means during said injection stroke, and means for exhausting fuel from said timing chamber at substantially the end of each injection stroke.

12. Apparatus as in claim 11, wherein said exhausting means comprises a spill passage for spilling fuel from said timing chamber, said spill passage being located to be opened by movement of said piston at substantially the end of said injection stroke.

13. Apparatus as in claim 11, wherein said variable pressure fuel supply adjusts the pressure of said timing fuel as a function of engine speed and engine load.

14. Apparatus as in claim 11, wherein said body has an elongated cylindrical bore formed therein, said charge and timing chambers being formed by portions of said bore, and said piston and said plunger being in axial alignment.

15. Apparatus as in claim 11, wherein said chambers are laterally offset in said body and are connected by a passage, said plunger and said piston being respectively mounted in said timing and charge chambers.

16. Apparatus as in claim 11, wherein said body forms an injector, and said fuel outlet passage means leads directly to a combustion chamber of said engine.

17. Apparatus as in claim 11, and further including distributor means connected to receive fuel from said fuel outlet passage means, and a plurality of injectors, said distributor means distributing fuel sequentially to said plurality of injectors.

18. Apparatus as in claim 17, wherein said distributor means comprises a rotor and a stator, said stator having a plurality of spaced passages leading to said injectors, said rotor being connected to receive fuel from said fuel outlet passage means and deliver it sequentially to said spaced passages of said stator, and means for moving said rotor in timed relation with said engine and said plunger.

19. Apparatus as in claim 17, wherein said distributor means comprises an axially extending slot formed in said plunger, said fuel outlet passage means leading to said slot, means for rotating said plunger during its reciprocating movement, and a plurality of outlet passages formed in said body at angularly spaced locations, said slot being sequentially aligned with said outlet passages of said body as said plunger is rotated.

20. Apparatus as in claim 11, wherein said plunger is elongated and said timing chamber is formed in said plunger, said piston being reciprocably mounted in said timing chamber in said plunger.

21. Apparatus as in claim 11, wherein said timing fuel flow passage means has a fuel flow restricting orifice formed therein.

22. Apparatus as in claim 21, wherein said plunger is movable to close said timing fuel flow passage means when said timing chamber is filled with fuel.

23. Apparatus as in claim 11, and further including a metering spring connected to said timing piston and urging said piston in one direction, said charge fuel entering said charge chamber exerting a force on said piston in the opposite direction, charge fuel flowing into said charge chamber until the force exerted by it counterbalances the force exerted by said metering spring.

24. Apparatus as in claim 11, wherein said charge fuel flow passage means has a fuel flow restricting orifice formed therein.

25. Apparatus as in claim 24, and further including ball chamber means connected to said timing chamber for preventing a suction and pumping action from occurring during said retraction stroke.

26. Apparatus as in claim 11, wherein said pump body forms an injector housing, and further including lost motion means connecting said plunger and said piston, and a ball chamber connected to said charge chamber.

27. Apparatus as in claim 11, wherein said pump body forms an injector housing, and further including another chamber formed in said body between said plunger and said reciprocating means and connected to a low pressure fluid supply.

28. Fuel supply apparatus for a compression-ignition engine, comprising means for pumping fuel from a supply, first regulating means connected to receive pumped fuel and to regulate the pressure of the fuel as a function of engine speed and engine load, a pump body having a charge chamber and a timing chamber formed therein, a timing piston reciprocably mounted in said charge chamber and separating said charge and timing chambers, a plunger reciprocably mounted in said body and movable in said timing chamber, charge fuel flow passage means in said body for carrying charge fuel from said regulating means to said charge chamber, second regulating means responsive to at least one engine operating parameter for supplying timing fuel at a pressure which is a function of said parameters, timing fuel flow passage means in said housing for carrying timing fuel to said timing chamber, means for reciprocating said plunger in injection and retraction strokes in timed relation with the operation of said engine, the quantity of timing fuel in said timing chamber forming a hydraulic link between said plunger and said piston during said injection stroke, fuel outlet passage means connected to said charge chamber for carrying fuel from said charge chamber during said injection stroke, and means for exhausting fuel from said timing chamber at substantially the end of each injection stroke.

29. Apparatus as in claim 28, wherein said parameter is engine speed.

30. Apparatus as in claim 28, wherein said parameter is engine load.

31. Apparatus as in claim 28, wherein said first regulating means provides a first fuel signal having a pressure representing engine speed and a second fuel signal having a pressure representing engine load, and said second regulating means receives pumped fuel from said pumping means and includes pressure modifying means responsive to said first and second fuel signals, said modifying means supplying said timing fuel to said timing chamber.

* * * * *